US010698328B2

(12) United States Patent
Kawamura et al.

(10) Patent No.: US 10,698,328 B2
(45) Date of Patent: Jun. 30, 2020

(54) ELECTROSTATIC IMAGE DEVELOPING TONER

(71) Applicant: Konica Minolta, Inc., Tokyo (JP)

(72) Inventors: Takaki Kawamura, Hino (JP); Shiro Hirano, Hachioji (JP); Junya Onishi, Hachioji (JP); Ami Motohashi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/235,535

(22) Filed: Dec. 28, 2018

(65) Prior Publication Data

US 2019/0258185 A1 Aug. 22, 2019

(30) Foreign Application Priority Data

Feb. 20, 2018 (JP) ..... 2018-027590

(51) Int. Cl.
*G03G 9/087* (2006.01)
*G03G 9/08* (2006.01)

(52) U.S. Cl.
CPC ..... *G03G 9/08711* (2013.01); *G03G 9/08* (2013.01); *G03G 9/08755* (2013.01); *G03G 9/08782* (2013.01); *G03G 9/08795* (2013.01); *G03G 9/08797* (2013.01)

(58) Field of Classification Search
CPC ..... G03G 9/08711; G03G 9/08755; G03G 9/08797; G03G 9/08782; G03G 9/08795; G03G 9/08
See application file for complete search history.

(56) References Cited

U.S. PATENT DOCUMENTS

2016/0370722 A1* 12/2016 Sugama ..... G03G 9/08713
2017/0168407 A1* 6/2017 Onishi ..... G03G 9/0804

FOREIGN PATENT DOCUMENTS

JP 2014174262 A 9/2014

* cited by examiner

*Primary Examiner* — Thorl Chea
(74) *Attorney, Agent, or Firm* — Lucas & Mercanti, LLP

(57) ABSTRACT

Provided is an electrostatic image developing toner including: toner mother particles containing a binder resin and a releasing agent; and an external additive, wherein the binder resin contains a crystalline resin, and the electrostatic image developing toner satisfies the following formulas (1) and (2), $$\tan\delta_{3^\circ\ C./min} < \tan\delta_{6^\circ\ C./min} \quad \text{Formula (1):}$$

$$0.0005 \leq \tan\delta_{6^\circ\ C./min} - \tan\delta_{3^\circ\ C./min}, \quad \text{Formula (2):}$$

wherein: $\tan\delta_{6^\circ\ C./min}$ is a peak top value of a loss tangent when the loss tangent is measured from 25° C. to 100° C. at a frequency of 1 Hz and a heating rate of 6° C./min; and $\tan\delta_{3^\circ\ C./min}$ is a peak top value of a loss tangent when the loss tangent is measured from 25° C. to 100° C. at a frequency of 1 Hz and a heating rate of 3° C./min.

8 Claims, 2 Drawing Sheets

ELECTROSTATIC IMAGE DEVELOPING TONER

Japanese Patent Application No. 2018-027590, filed on Feb. 20, 2018 with Japan Patent Office, is incorporated herein by reference in its entirety.

TECHNICAL FIELD

The present invention relates to an electrostatic image developing toner. More specifically, the resent invention relates to an electrostatic image developing toner enabling to achieve both low-temperature fixability and heat-resistant storage property, and easy to control the glossiness of the image against the linear speed, temperature and pressure at the time of fixing.

BACKGROUND

In order to increase the printing speed and energy saving of the image forming apparatus, an electrostatic image developing toner (hereinafter also simply referred to as "toner") used for electrophotographic image formation is required to reduce thermal energy during fixing. In correspondence to this requirement, a toner excellent in further low-temperature fixability is desired. As such a toner, for example, a crystalline polyester resin having a sharp melt property is introduced as a binder resin into a toner as disclosed in Patent Document 1 (JP-A 2014-174262). Thereby it is known that by manipulating the rheological properties and controlling the viscoelastic behavior, it is possible to achieve both low-temperature fixability and heat-resistant storage property at the same time. However, control of the viscoelastic behavior alone as described in Patent Document 1 is not sufficient, and it became clear that there was a problem in gloss controllability when printing speed and fixing conditions were different.

SUMMARY

The present invention has been made in view of the above problems and circumstances. An object of the present invention is to provide an electrostatic image developing toner using a crystalline resin enabling to achieve both low-temperature fixability and heat-resistant storage property, and easy to control the glossiness of the image against the linear speed, temperature and pressure at the time of fixing.

In order to solve the above problem, the present inventors have achieved the present invention in the course of examining the causes of the above problems. That is, it was found to provide an electrostatic image developing toner capable of achieving both low-temperature fixability and heat-resistant storage property, and easy to control the glossiness of the image against the linear speed, temperature and pressure at the time of fixing by incorporating a crystalline resin therein and by setting the peak top value of the loss tangent (tan δ) when the heating rate of the toner is different to satisfy a specific relationship. That is, the above object of the present invention can be attained by the following means.

An electrostatic image developing toner reflecting an aspect of the present invention is an electrostatic image developing toner comprising: toner mother particles containing a binder resin and a releasing agent; and an external additive, wherein the binder resin contains a crystalline resin, and the electrostatic image developing toner satisfies the following formulas (1) and (2), $$\tan \delta_{3^\circ\ C./min} < \tan \delta_{6^\circ\ C./min} \quad \text{Formula (1):}$$

$$0.0005 \leq \tan \delta_{6^\circ\ C./min} - \tan \delta_{3^\circ\ C./min}, \quad \text{Formula (2):}$$

wherein: $\tan \delta_{6^\circ\ C./min}$ is a peak top value of a loss tangent when the loss tangent is measured from 25° C. to 100° C. at a frequency of 1 Hz and a heating rate of 6° C./min; and $\tan \delta_{3^\circ\ C./min}$ is a peak top value of a loss tangent when the loss tangent is measured from 25° C. to 100° C. at a frequency of 1 Hz and a heating rate of 3° C./min.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Hereinafter, one or more embodiments of the present invention will be described with reference to the drawings. However, the scope of the invention is not limited to the disclosed embodiments.

By the above-described embodiments, it is possible to provide an electrostatic image developing toner containing a crystalline resin enabling to achieve both low-temperature fixability and heat-resistant storage property, and easy to control the glossiness of the image against the linear speed, temperature and pressure at the time of fixing. A formation mechanism or an action mechanism of the effects of the present invention is not clearly identified, but it is supposed as follows.

Figure 1:
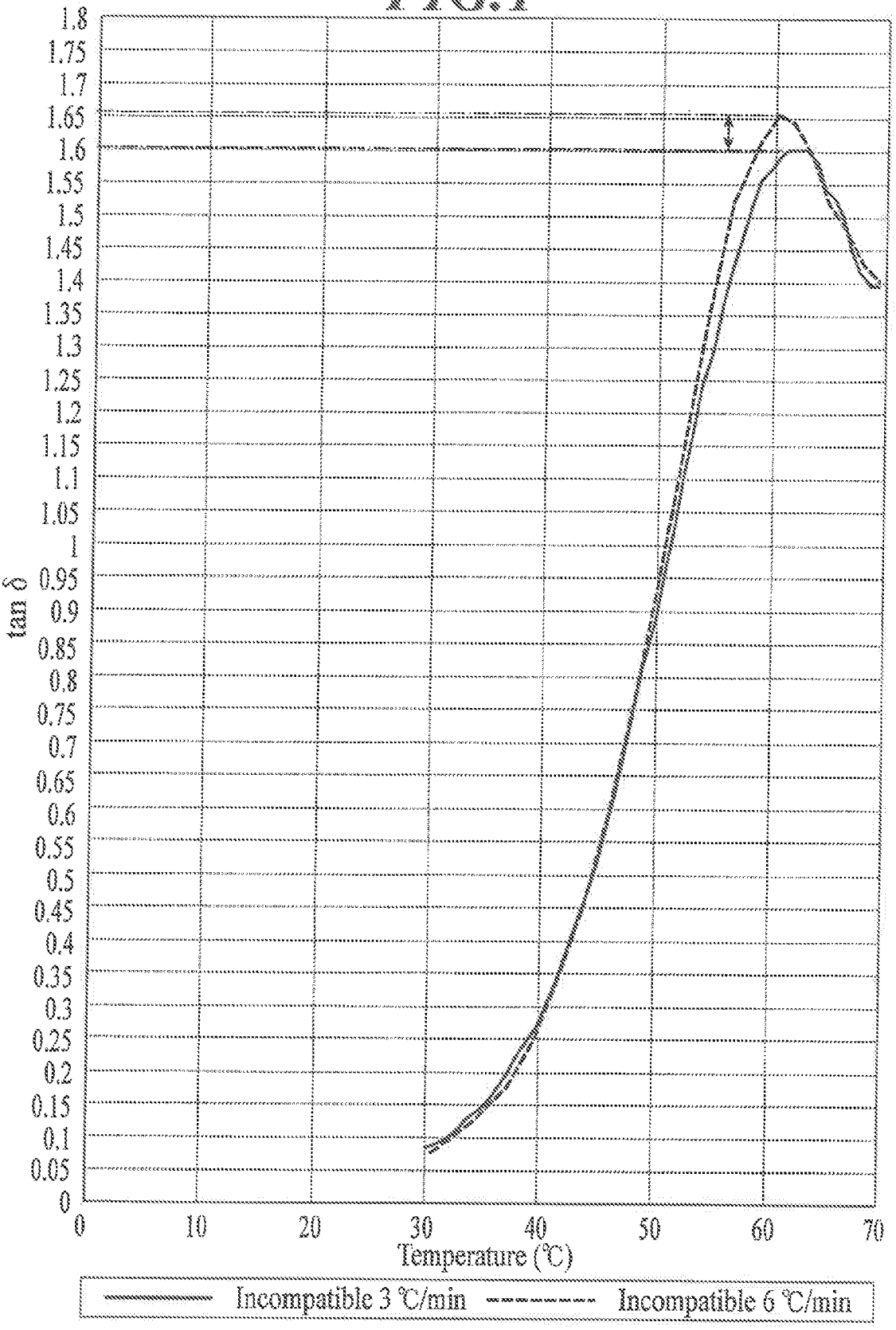
FIG. 1 is a graph illustrating $\tan \delta_{6^\circ\ C./min}$ and $\delta_{3^\circ\ C./min}$ in an incompatible system.

As indicated in FIG. 1, when looking at the first peak of tan δ, the tan δ value increases as the heating rate becomes faster, and the influence of the viscous component becomes larger. The slower the heating rate, the smaller the value of tan δ and the stronger the effect of the elastic component. This is considered to be due to the fact that the binder resin and the crystalline resin are incompatible with each other, so that when the heating rate is high, the influence on the viscoelasticity due to the motion of the crystalline material is large and the viscous component is strong. As the heating rate slows down, viscoelasticity can be measured uniformly and the elastic component is considered to be strong.

Figure 2:
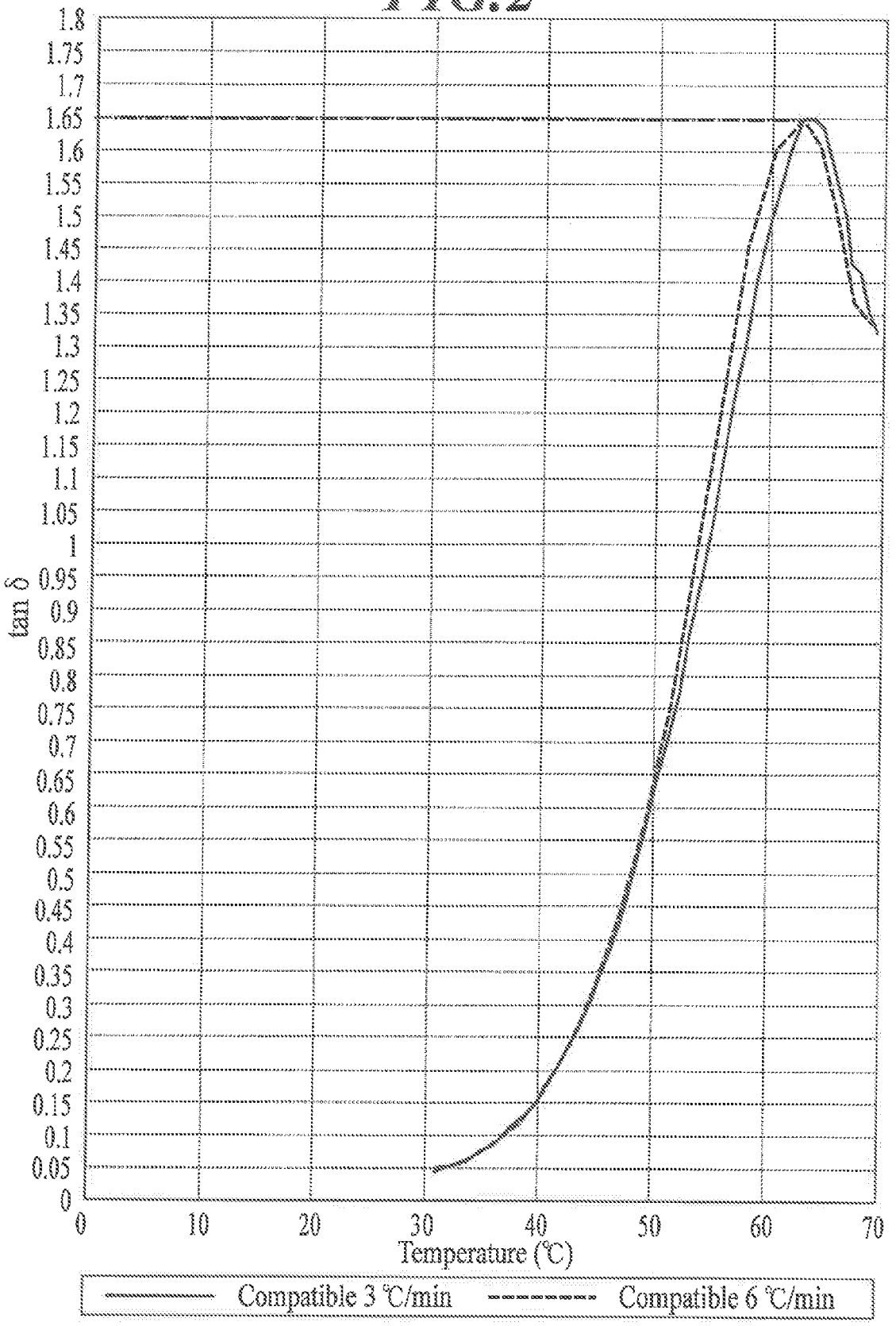
FIG. 2 is a graph illustrating $\tan \delta_{6^\circ\ C./min}$ and $\delta_{3^\circ\ C./min}$ in a compatible system.

On the other hand, as indicated in FIG. 2, in the case of the compatibility relationship, the balance between the viscosity and the elasticity due to the difference in the heating rate does not change. It is considered that this is a state of compatibility, so that viscoelasticity measurement can always be performed uniformly. In the present invention, it is possible to control the balance between the viscosity and the elasticity in the toner by setting the relationship of tan δ to satisfy the formulas (1) and (2) when the heating rate is different. As a result, it is possible to make full use of the properties of the crystalline resin and to achieve both low-temperature fixing property and heat-resistant storage property. Furthermore, since it is possible to change the balance between viscosity and elasticity with respect to the linear speed, temperature and pressure at the time of fixing, it is conceivable that the gloss of the image may be easily controlled.

An electrostatic image developing tone of the present invention includes: toner mother particles containing a binder resin and a releasing agent; and an external additive, wherein the binder resin contains a crystalline resin, and the electrostatic image developing toner satisfies the following formulas (1) and (2), $$\tan \delta_{3^\circ\ C./min} < \tan \delta_{6^\circ\ C./min} \quad \text{Formula (1):}$$

$$0.0005 \leq \tan \delta_{6^\circ\ C./min} - \tan \delta_{3^\circ\ C./min}, \quad \text{Formula (2):}$$

wherein: $\tan \delta_{6^\circ\ C./min}$ is a peak top value of a loss tangent when the loss tangent is measured from 25° C. to 100° C. at a frequency of 1 Hz and a heating rate of 6° C./min; and $\tan \delta_{3^\circ\ C./min}$ is a peak top value of a loss tangent when the loss tangent is measured from 25° C. to 100° C. at a frequency of 1 Hz and a heating rate of 3° C./min.

This feature is a technical feature common or corresponding to the following embodiments.

In an embodiment of the present invention, it is preferable to satisfy the relationship of the following formula (3) from the viewpoint that a difference between compatibility and incompatibility can be obtained. In addition, satisfying the relationship of the following formula (4) is a most preferable embodiment from the viewpoint of achieving balance control of crystallization as an incompatible system, and being excellent in gloss control and realizing high heat-resistance.

$$0.001 \leq \tan \delta_{6^\circ\ C./min} - \tan \delta_{3^\circ\ C./min} \quad \text{Formula (3):}$$

$$0.01 \leq \tan \delta_{6^\circ\ C./min} - \tan \delta_{3^\circ\ C./min} \leq 0.15 \quad \text{Formula (4):}$$

Further, satisfying the relationships of the following formulas (5) and (6) is preferable in view of compatibility of low-temperature fixability and heat-resistant storage stability.

$$1.1 \leq \tan \delta_{6^\circ\ C./min} \leq 1.7 \quad \text{Formula (5):}$$

$$1.1 \leq \tan \delta_{3^\circ\ C./min} \leq 1.7 \quad \text{Formula (6):}$$

In addition, it is preferable to contain a crystalline polyester resin as the crystalline resin from the viewpoint of excellent low-temperature fixability. It is further preferable that the crystalline resin contains a hybrid resin in which a crystalline polyester segment and a resin unit other than the crystalline polyester are chemically bonded, so that compatible and incompatible switching becomes easy and viscoelasticity is easily controlled.

In addition, when the vinyl-based resin is the main component in the binder resin, adjustment of compatibility and incompatibility with the crystalline resin is easily done. In particular, since the crystalline resin and the vinyl-based resin are different in structure of the resin, it is preferable from the viewpoint of easily achieving incompatibility.

In addition, it is preferable that the binder resin contains a vinyl-based resin as a main component and further contains an amorphous polyester resin. For the reasons described above, it is preferable that the vinyl-based resin is a main component. Further, by containing the amorphous polyester resin, compatibility with the crystalline resin is easily adjusted. In addition, when a core-shell structure is used and an amorphous polyester resin is used for the shell, it is preferable from the viewpoint of achieving excellent heat-resistance.

In addition, it is preferable to contain two kinds of crystalline resins are contained as the crystalline resin in view of adjusting compatibility and incompatibility, and the existence of crystalline resins having a different melting point makes it possible to facilitate crystallization of the crystalline resin. Further, it is preferable to include two kinds of releasing agents as the releasing agent in view of adjusting compatibility and incompatibility, and the presence of releasing agents having different melting points makes it possible to facilitate crystallization of the crystalline resin.

Hereinafter, the present invention and the constitution elements thereof, as well as configurations and embodiments for carrying out the present invention will be detailed in the following. In the present description, when two figures are used to indicate a range of value before and after "to", these figures are included in the range as a lowest limit value and an upper limit value.

[Electrostatic Image Developing Toner]

An electrostatic image developing toner of the present invention contains: toner mother particles containing a binder resin and a releasing agent; and an external additive, wherein the binder resin contains a crystalline resin, and the electrostatic image developing toner satisfies the following formulas (1) and (2), $$\tan \delta_{3^\circ\ C./min} < \tan \delta_{6^\circ\ C./min} \quad \text{Formula (1):}$$

$$0.0005 \leq \tan \delta_{6^\circ\ C./min} - \tan \delta_{3^\circ\ C./min}, \quad \text{Formula (2):}$$

wherein: $\tan \delta_{6^\circ\ C./min}$ is a peak top value of a loss tangent when the loss tangent is measured from 25° C. to 100° C. at a frequency of 1 Hz and a heating rate of 6° C./min; and $\tan \delta_{3^\circ\ C./min}$ is a peak top value of a loss tangent when the loss tangent is measured from 25° C. to 100° C. at a frequency of 1 Hz and a heating rate of 3° C./min.

<Measuring Method of Loss Tangent Tan δ>

The following was used as a measurement sample, 0.2 g of toner with an external additive was weighed and pressure molding was performed by applying a pressure of 25 MPa with a compression molding machine to prepare a columnar pellet having a diameter of 10 mm. Using a rheometer (ARES G 2, manufactured by TA Instruments, Co. Ltd.), temperature rise measurement was carried out under the condition of a frequency of 1 Hz using a parallel plate having a diameter of 8 mm in upper and lower sets. The sample set was performed at 100° C., once the gap was set to 1.6 mm, scraping of the sample protruding from between the plates was performed. Thereafter, the gap was set to 1.4 mm, and the sample was cooled to 25° C. while applying an axial force and left to stand for 10 minutes. Then the axial force was stopped, and temperature rise measurement of storage elastic modulus (G') from 25° C. to 100° C. was performed. The measurement was performed using different samples at the heating rate of 3° C./min and 6° C./min.

Detailed measurement conditions are indicated below.

Frequency: 1 Hz

Ramp rate: 3° C./min and 6° C./min

Axial force: 0 g, Sensitivity: 10 g

Initial strain: 0.01%, Strain adjust: 30.0%.

Minimum strain: 0.01%. Maximum strain: 10.0%

Minimum torque: 1 g·cm, Maximum torque: 80 g·cm

Sampling interval: 1.0° C./pt

In the measurement from 25° C. to 100° C., the value of the peak top of the first peak clearly seen is defined as the loss tangent tan δ.

Satisfying the above formula (1) indicates that the crystalline resin and the binder resin are incompatible in the toner. Further, satisfying the above formula (2) indicates that the crystalline resin and the binder resin are incompatible in the toner. That is, unless the value of tan ($\delta_{6°\ C./min}$−tan $\delta_{3°\ C./min}$) is not less than 0.0005, there is no difference between compatibility and incompatibility, and the behavior of the system will be the same as the compatibility system.

Further, it is preferable that tan $\delta_{6°\ C./min}$ and tan $\delta_{3°\ C./min}$ satisfy the following formula (3) from the viewpoint that a difference between compatibility and incompatibility can be obtained and the range of gloss control is widened. In addition, satisfying the relationship of the formula (4) is a most preferable embodiment from the viewpoint of achieving balance control of crystallization as an incompatible system, and being excellent in gloss control and realizing high heat-resistance.

$$0.001 \leq \tan \delta_{6°\ C./min} - \tan \delta_{3°\ C./min} \quad \text{Formula (3):}$$

$$0.01 \leq \tan \delta_{6°\ C./min} - \tan \delta_{3°\ C./min} \leq 0.15 \quad \text{Formula (4):}$$

Further, satisfying the relationships of the following formulas (5) and (6) is preferable in view of compatibility of low-temperature fixability and heat-resistant storage stability. When the absolute value of tan $\delta_{6°\ C./min}$ and tan $\delta_{3°\ C./min}$ is 1.1 or less, the effect of elasticity is large and the heat-resistance is excellent, but the low-temperature fixability deteriorates. Conversely, when it is 1.7 or more, the influence of the viscosity is large and the low-temperature fixability is excellent but the heat-resistant storage property is poor.

$$1.1 \leq \tan \delta_{6°\ C./min} \leq 1.7 \quad \text{Formula (5):}$$

$$1.1 \leq \tan \delta_{3°\ C./min} \leq 1.7 \quad \text{Formula (6):}$$

In the present invention, as means for tan $\delta_{6°\ C./min}$ and tan $\delta_{3°\ C./min}$ to satisfy the relationships of the above formulas (1) and (2), it is preferable to use two crystalline resins and to adjust the solution viscosity of the crystalline resin to be in the range of 9 to 13 mPa·s. When two crystalline resins are used, for example, one of the crystalline resins is preferably a crystalline polyester resin or a hybrid crystalline polyester resin that is described later. Further, it is more preferable that both of the two crystalline resins are a hybrid crystalline polyester resin. By using two kinds of crystalline resins in this way, it is easy to switch between compatible and incompatible with respect to the binder resin, and viscoelasticity is easily controlled. Further, by making the solution viscosity of the crystalline resin within the above range, the influence of viscosity on incompatibility is large and the value of tan S may be increased. As a technique for adjusting the solution viscosity of the crystalline resin, the material composition, the content (hybrid ratio) of the resin units other than the crystalline polyester in the hybrid crystalline polyester resin, and the number average molecular weight (Mn) of the crystalline resin are adjusted, for example. As the material composition, the solution viscosity can be adjusted by the carbon chain of the divalent or higher carboxylic acid (polyvalent carboxylic acid) and its derivative and the dihydric or higher alcohol (polyhydric alcohol) and its derivative both constituting a crystalline polyester resin. The longer the carbon chain, the lower the solution viscosity can be made.

The hybrid ratio is preferably 5 mass % or more and less than 20 mass %, and more preferably 5 mass % or more and less than 15 mass % with respect to the total amount of the hybrid crystalline polyester resin. By setting this range, it is possible to impart sufficient crystallinity to the hybrid resin. The number average molecular weight (Mn) of the crystalline resin is preferably in the range of 2,500 to 5,000, and more preferably in the range of 3,000 to 4,500. Further, by controlling the amount of (meth)acrylate monomer (for example, 2-ethylhexyl acrylate (2EHA)) of a vinyl resin (styrene-acrylic resin) which is a binder resin, the relationship of compatibility-incompatibility may be adjusted.

<Toner Mother Particles>

The toner mother particles according to the present invention contain a binder resin and a releasing agent (wax). Besides, the toner mother particles may contain other constitutional components, such as a colorant and a charge controlling agent, when necessary.

A toner mother particle to which an external additive is added is called a toner particle, and an aggregate of toner particles is called a toner. In general, the toner mother particles may be used as it is, but in the present invention, toner mother particles to which external additives are added are used as toner particles.

<Binder Resin>

The binder resin according to the present invention contains at least a crystalline resin. In addition, when the vinyl-based resin is the main component in the binder resin, adjustment of compatibility and incompatibility with the crystalline resin is easily done. In particular, since the crystalline resin and the vinyl-based resin are different in structure of the resin, it is preferable from the viewpoint of easily achieving incompatibility.

In addition, it is preferable that the binder resin contains a vinyl-based resin as a main component and further contains an amorphous polyester resin. For the reasons described above, it is preferable that the vinyl-based resin is a main component. Further, by containing the amorphous polyester resin, compatibility with the crystalline resin is easily adjusted. In addition, when a core-shell structure is used and an amorphous polyester resin is used for the shell, it is preferable from the viewpoint of achieving excellent heat-resistance. Further, it is preferable that the crystalline resin is a crystalline polyester resin from the viewpoint of excellent low-temperature fixability. In addition, it is preferable to contain a crystalline polyester resin as the crystalline resin from the viewpoint of excellent low-temperature fixability. It is further preferable that the crystalline resin contains a hybrid resin in which a crystalline polyester segment (it may be called as a polyester polymerization segment) and a resin unit other than the crystalline polyester (it may be called as other polymerization segment) are chemically bonded, so that compatible and incompatible switching becomes easy and viscoelasticity is easily controlled.

(Crystalline Resin)

In this specification, the crystalline resin indicates a resin having a distinct endothermic peak, rather than a stepwise endothermic change, in differential scanning calorimetry (DSC). The distinct endothermic peak indicates an endothermic peak having a half width within 15° C. or less at a heating rate of 10° C./min in the DSC.

From the viewpoint of obtaining sufficient high-temperature storage property, the melting point (Tmc) of the crystalline resin is preferably 60° C. or more, and from the viewpoint of obtaining sufficient low-temperature fixability, it is preferably from 85° C. or less.

The melting point (Tmc) of the crystalline resin may be measured by DSC. Specifically, 0.5 mg of measuring sample (crystalline resin) is enclosed in an aluminum pan (KIT NO. B0143013), and it is set to a sample holder of "Diamond DSC" (manufactured by PerkinElmer, Inc.). The temperature is changed in the order of heating-cooling-heating. During the first heating and the second heating, the temperature is raised from room temperature (25° C.) to 150° C. at a heating rate of 10° C./min, and the temperature is held at 150° C. for 5 minutes. At the time of cooling, the temperature is lowered from 150° C. to 0° C. at a cooling rate of 10° C./min, and the temperature of 0° C. is held for 5 minutes. The temperature at the peak top of the endothermic peak in the endothermic curve obtained at the second heating is measured as the melting point (Tmc) of the crystalline resin.

The content of the crystalline resin relative to the toner mother particles is preferably in the range of 5 to 20 mass %, more preferably in the range of 7 to 15 mass % from the viewpoint of obtaining sufficient low-temperature fixing property. When the content is 5 mass % or more, sufficient plasticizing effect is obtained and low-temperature fixing property is sufficient. In addition, when the content is 20 mass % or less, thermal stability as a toner and stability against physical stress are sufficient.

The crystalline resin is not particularly limited, and examples thereof include a polyolefin-based resin, a polydiene-based resin, and a polyester-based resin. Among them, a crystalline polyester resin is preferable from the viewpoint of obtaining sufficient low-temperature fixability and gloss uniformity and easy to use.

The number average molecular weight (Mn) of the crystalline resin is preferably in the range of 2,500 to 5,000, more preferably in the range of 3,000 to 4,500 as described above. Within these ranges, the solution viscosity of the crystalline resin may be adjusted to the above-mentioned preferable range. In addition, the strength of the fixed image does not become insufficient, the crystalline resin is not pulverized during agitation of the developer, the glass transition temperature Tg of the toner is not lowered due to excessive plasticizing effect, and the thermal stability of the toner is not lowered. In addition, sharp melt properties are developed and low-temperature fixing becomes possible. The above Mn can be determined from the molecular weight distribution measured by gel permeation chromatography (GPC) as follows.

Specifically, the measurement sample is added to tetrahydrofuran (THF) to a concentration of 0.1 mg/mnL, and it heated to 40° C. to dissolve. Then it is treated with a membrane filter with a pore size of 0.2 μm. Thus a sample solution is prepared. A measuring device "HLC-8220 GPC" (Tosoh Corp.) and a column set "TSK gel Super H3000" (Tosoh Corp.) are used. The column temperature is held at 40° C., and tetrahydrofuran (THF) is supplied at a flow rate of 0.6 mL/min as a carrier solvent. An aliquot (100 μL) of the sample solution is injected into the GPC device along with the carrier solvent and is detected by means of a refractive index (RI) detector. The molecular weight distribution of the sample is calculated by using a calibration curve. The calibration curve is obtained by using 10 kinds of monodispersed polystyrene standard particles. At this time, in the data analysis, when the peak due to the filter is confirmed, the area before the peak is set as the baseline.

The crystalline polyester resin is obtained by a polycondensation reaction of a divalent or higher valent carboxylic acid (polyvalent carboxylic acid) and a dihydric or higher alcohol (polyhydric alcohol).

Examples of the polyvalent carboxylic acid include dicarboxylic acids. This dicarboxylic acid may be one kind or more, and it is preferably an aliphatic dicarboxylic acid, and may further contain an aromatic dicarboxylic acid. The aliphatic dicarboxylic acid is preferably a linear type from the viewpoint of enhancing the crystallinity of the crystalline polyester.

Examples of the aliphatic dicarboxylic acid include: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, and 1,18-octadecanedicarboxylic acid. The lower alkyl esters of these acids and their anhydrides are included. Among these aliphatic dicarboxylic acids, preferred are aliphatic dicarboxylic acids having 6 to 16 carbon atoms, and more preferred are aliphatic dicarboxylic acids having 10 to 14 carbon atoms from the viewpoint of easily achieving both low-temperature fixability and transferability.

Examples of the aromatic dicarboxylic acid include: terephthalic acid, isophthalic acid, orthophthalic acid, t-butylisophthalic acid, 2,6-naphthalenedicarboxylic acid, and 4,4'-biphenyldicarboxylic acid. Among these aromatic dicarboxylic acids, preferred are terephthalic acid, isophthalic acid, and t-butylisophthalic acid in view of availability and ease of emulsification.

From the viewpoint of sufficiently securing the crystallinity of the crystalline polyester, the content of the constituent unit derived from the aliphatic dicarboxylic acid to the constituent unit derived from the dicarboxylic acid in the crystalline polyester resin is preferably 50 mol % or more. More preferably it is 70 mol % or more, further preferably 80 mol % or more, particularly preferably 100 mol %.

Examples of the polyhydric alcohol component include diols. The diol may be one kind or more, and it is preferably an aliphatic diol, and may further contain other diol. From the viewpoint of enhancing the crystallinity of the crystalline polyester, the aliphatic diol is preferably a linear type.

Examples of the aliphatic diol include: ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these, from the viewpoint of easily achieving both low-temperature fixability and transferring effect, the diol component is preferably aliphatic diols having 2 to 12 carbon atoms, more preferably aliphatic diols having 4 to 6 carbon atoms.

Examples of the other diol include a diol having a double bond and a diol having a sulfonic acid group. Specific examples of the diol having a double bond include: 2-butene-1,4-diol, 3-hexene-1,6-diol, and 4-octene-1,8-diol.

From the viewpoint of enhancing the low-temperature fixability of the toner and the glossiness of the finally formed image, the content of the constitutional unit derived from the aliphatic diol relative to the diol-derived constituent unit in the crystalline polyester resin is preferably 50 mol % or more, more preferably 70 mol % or more, further preferably 80 mnol % or more, and particularly preferably 100 mol %.

The ratio of the diol component to the dicarboxylic acid component, i.e., at the equivalent ratio [OH]/[COOH] of the hydroxy groups [OH] in the diol component the carboxy groups [COOH] in the dicarboxylic acid component is preferably in the range of 2.0/1.0 to 1.0/2.0, more preferably in the range of 1.5/1.0 to 1.0/1.5, particularly preferably in the range of 1.3/1.0 to 1.0/1.3.

The monomer constituting the crystalline polyester resin preferably contains 50 mass % or more of the linear aliphatic monomer, more preferably 80 mass % or more. When an aromatic monomer is used, the melting point of the crystalline polyester resin tends to be high, and when a branched type aliphatic monomer is used, the crystallinity tends to be low. Therefore, it is preferable to use a linear aliphatic monomer as the monomer. From the viewpoint of maintaining the crystallinity of the crystalline polyester resin in the toner, it is preferable to use a linear aliphatic monomer at 50 mass % or more, more preferably at 80 mass % or more.

The crystalline polyester resin is may be prepared by polycondensation (esterification) of the aforesaid polyvalent carboxylic acid and polyhydric alcohol in the presence of a known esterification catalyst.

The catalyst which can be used for the synthesis of the crystalline polyester resin may be one kind or more. Examples of the catalyst include: compounds of alkali metals such as sodium and lithium; compounds containing Group II elements, such as magnesium and calcium; compounds of metals, such as aluminum, zinc, manganese, antimony, titanium, tin, zirconium, and germanium; phosphite compounds; phosphate compounds; and amine compounds.

Specific examples of tin compounds include: dibutyltin oxide, and organic tin salts, such as tin octylate and tin dioctylate. Examples of titanium compounds include titanium alkoxides, such as tetra-n-butyl titanate, tetraisopropyl titanute, tetramethyl titanmte, and tetrastearyl titanmte; titanium acylates, such as polyhydroxytitanium stearate; and titanium chelates, such as titanium tetmracetylacetonate, titanium lactate, and titanium triethanolaminate. Examples of germanium compounds include germanium dioxide. Examples of aluminum compounds include aluminum oxides, such as aluminum polyhydroxide; aluminum alkoxides; and tributyl aluminate.

The polymerization of the crystalline polyester resin may be carried out preferably in the range of 150 to 250° C. The preferred polymerization time is in the range of 0.5 to 10 hours. The pressure of the reaction system may be reduced during polymerization as needed.

The crystalline resin according to the present invention may be of one type, but is preferably of two types. Specifically, it is more preferable to use two hybrid crystalline polyester resins.

(Amorphous Resin)

The binder resin according to the present invention preferably contains a vinyl resin as a main component. In the present invention, the main component means that it is contained in the binder resin in an amount of 50 mass % or more. Further, it is preferable to contain an amorphous polyester resin.

The amorphous resin according to the present invention is a resin having no crystallinity. The amorphous resin is a resin having no melting point and a relatively high glass transition temperature (Tg) when subjected to differential scanning calorimetry (DSC) of toner particles.

The Tg of the amorphous resin is preferably in the range of 35 to 80° C., particularly preferably in the range of 45 to 65° C.

The glass transition temperature is a value measured by the method (DSC method) specified in D3418-82 of ASTM (American Society for Testing and Materials). For the measurement, a differential scanning calorimeter DSC-7 (manufactured by PerkinEhner, Co.), a thermal analyzer controller TAC7/DX (manufactured by PerkinElmer, Co.) may be used.

The amorphous resin may be one kind or more. Examples of the amorphous resin include vinyl resins, urethane resins, urea resins and amorphous polyester resins such as styrene-acrylic modified polyesters. In the present embodiment, from the viewpoint of easy control of thermoplasticity, it is preferable that the amorphous resin contains a vinyl resin as a main component in the binder resin, and it is also preferable to contain an amorphous polyester resin.

The above vinyl resin is, for example, a polymer of a vinyl compound, examples of which include an acrylic acid ester resin, a styrene-acrylate resin, and an ethylene-vinyl acetate resin. Among them, from the viewpoint of plasticity at the time of thermal fixing, a styrene-acrylate resin (styrene-acrylic resin) is preferable.

The styrene-acrylic resin is prepared through addition polymerization of at least a styrene monomer and a (meth) acrylate ester monomer. In this specification, the styrene monomer indicates styrene represented by the formula $CH_2{=}CH{-}C_6H_5$, and also includes monomers having a known side chain or functional group in a styrene structure.

In this specification, the (meth)acrylate ester monomer indicates an acrylate or methacrylate ester compound represented by $CH(R_1){=}CHCOOR_2$ (where $R_1$ represents a hydrogen atom or a methyl group and $R_2$ represents an alkyl group having 1 to 24 carbon atoms), and also includes ester compounds having a known side chain or functional group in the structure, such as acrylate ester derivatives and methacrylate ester derivatives.

Examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene.

Examples of the (meth)acrylate ester monomer include acrylate ester monomers, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylate ester monomers, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

In this specification, the term "(meth)acrylate ester monomer" collectively indicates "acrylate ester monomer" and "methacrylate ester monomer". It means one or both of them. For example. "(meth)acrylic acid methyl" means one or both of "methyl acrylate" and "methyl methacrylate".

The (meth)acrylic acid ester monomer may be one kind or more. That is, it is possible to form a copolymer using any one of combinations of: a styrene monomer and two or more kinds of acrylate monomers; a styrene monomer and two or more kinds of methacrylate monomers; and a styrene monomer, an acrylate monomer, and a methacrylate monomer.

From the viewpoint of controlling the plasticity of the amorphous resin, the content of the constituent unit derived from the styrene monomer in the amorphous resin is preferably in the range of 40 to 90 mass. The content of the constitutional unit derived from the (meth)acrylate monomer in the amorphous resin is preferably in the range of 10 to 60 mass %.

The amorphous resin may further contain a constituent unit derived from a monomer other than the styrene monomer and the (meth)acrylate monomer. The other monomer is preferably a compound that is ester-bonded to a hydroxy group (—OH) derived from a polyhydric alcohol or a carboxyl group (—COOH) derived from a polyvalent carboxylic acid. Therefore, it is preferable that the amorphous resin is a polymer capable of doing addition polymerization to the styrene monomer and the (meth)acrylate monomer, and is produced by further polymerization with a compound having a carboxy group or a hydroxy group (amphoteric compound) in the molecule.

Examples of the above amphoteric compound include compounds containing a carboxy group such as acrylic acid, methacrylic acid, maleic acid, itaconic acid, cinnamic acid, fumaric acid, maleic acid monoalkyl ester, and itaconic acid monoalkyl; and compounds containing a hydroxy group such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono (meth)acrylate.

The content of the constitutional unit derived from the amphoteric compound in the amorphous resin is preferably in the range of 0.5 to 20 mass %.

The styrene-acrylic resin can be synthesized by a method of polymerizing a monomer using a known oil-soluble or water-soluble polymerization initiator. Specific examples of the oil-soluble polymerization initiator include the following azo-based or diazo-based polymerization initiators and peroxide-based polymerization initiators.

Examples of the azo-based or diazo-based polymerization initiators include 2,2'-azobis-(2,4-dimethylvaleronitrile), 2,2'-azobisisobutyronitrile, 1,1 '-azobis(cyclohexane-1-carbonitrile), 2,2'-azobis-4-methoxy-2,4-dimethylvaleronitrile, and azobisisobutyronitrile.

Examples of the peroxide-based polymerization initiator include benzoyl peroxide, methyl ethyl ketone peroxide, diisopropyl peroxycarbonate, cumene hydroperoxide, t-butyl hydroperoxide, di-t-butyl peroxide, dicuntyl peroxide, 2,4-dichlorobenzoyl peroxide, lauroyl peroxide, 2,2-bis-(4,4-t-butylperoxycyclobexyl)propane, and tris-(t-butylperoxy)triazine.

When the resin particles of the styrene-acrylic resin are formed by the emulsion polymerization method, a water-soluble polymerization initiator can be used. Specific examples of the water-soluble polymerization initiator include: persulfates such as potassium persulfate and ammonium persulfate; azobisaminodipropane acetate; azobiscyanovaleric acid and salts thereof; and hydrogen peroxide.

From the viewpoint of easily controlling the plasticity of the amorphous resin, the weight average molecular weight (Mw) of the amorphous resin is preferably in the range of 5,000 to 150,000, more preferably in the range of 10,000 to 70.000.

(Amorphous Polyester Resin)

The amorphous polyester resin is a polyester resin. It has a relatively high glass transition temperature (Tg) without having a melting point when subjected to differential scanning calorimetry (DSC). In addition, since the monomer constituting the amorphous polyester resin is different from the monomer constituting the crystalline polyester resin, it can be distinguished from the crystalline polyester resin by, for example, NMR analysis.

The amorphous polyester resin is obtained by a polycondensation reaction of a divalent or higher valent carboxylic acid (polyvalent carboxylic acid) and a dihydric or higher alcohol (polyhydric alcohol). Specific amorphous polyester resin is not particularly limited, and a conventionally known amorphous polyester resin in the present technical field may be used.

A specific production method of the amorphous polyester resin is not particularly limited. An amorphous polyester resin may be produced by polycondensation (esterification) of a polyvalent carboxylic acid and a polyhydric alcohol using a known esterification catalyst. There are no particular restrictions on the catalyst that may be used in the production, the temperature of polycondensation (esterification), and the time of polycondensation (esterification), and they are the same as those of the crystalline polyester resin.

The weight average molecular weight (Mw) of the amorphous polyester resin is not particularly limited, but it is preferably in the range of, for example, 5,000 to 100,000, more preferably in the range of 5,000 to 50,000. When the weight average molecular weight (Mw) is 5,000 or more, the heat resistant storage property of the toner may be improved, and when it is 100,000 or less, the low-temperature fixing property may be further improved. The weight average molecular weight (Mw) may be measured by the above-described method.

Examples of the polyvalent carboxylic acid and the polyhydric alcohol used for preparing the amorphous polyester resin are not particularly limited, but include the following.

<<Polyvalent Carboxylic Acid>>

As the polyvalent carboxylic acid, it is preferable to use unsaturated aliphatic polyvalent carboxylic acid, aromatic polyvalent carboxylic acid, and derivatives thereof. A saturated aliphatic polyvalent carboxylic acid may be used in combination as long as an amorphous resin can be formed.

Examples of the unsaturated aliphatic polyvalent carboxylic acid include: unsaturated aliphatic dicarboxylic acids such as methylene succinic acid, fumaric acid, maleic acid, 3-hexenedioic acid, 3-octenedioic acid, succinic acid substituted with an alkenyl group having 2 to 20 carbon atoms; unsaturated aliphatic tricarboxylic acids such as 3-butene-1,2,3-tricarboxylic acid, 4-pentene-1,2,4-tricarboxylic acid, and aconitic acid; and unsaturated aliphatic tetracarboxylic acid such as 4-Pentene-1, 2, 3, 4-tetracarboxylic acid. Lower alkyl esters and acid anhydrides of these compounds may also be used.

Examples of the unsaturated aromatic polyvalent carboxylic acid include: aromatic dicarboxylic acids such as phthalic acid, terephthalic acid, isophthalic acid, t-butylisophthalic acid, tetrachlorophthalic acid, chlorophthalic acid, nitrophthalic acid, p-phenylenediacetic acid, 2,6-naphthalenedicarboxylic acid, 4,4'-biphenyldicarboxylic acid, and anthracene dicarboxylic acid; aromatic tricarboxylic acids such as 1,2,3-benzenetricarboxylic acid (trimellitic acid), 1,2,5-benzenetricarboxylic acid (trimesic acid), 1,2,4-naphthalenetricarboxylic acid, and hemimellitic acid; aromatic tetracarboxylic acids such as pyromellitic acid and 1,2,3,4-butane tetracarboxylic acid; and aromatic hexacarboxylic acid such as melitic acid. Lower alkyl esters and acid anhydrides of these compounds may also be used.

The polyvalent carboxylic acid may be used alone or in combination of two or more.

<<Polyhydric Alcohol>>

As the polyhydric alcohol, from the viewpoint of controlling compatibility with the crystalline polyester resin, it is preferable to use unsaturated aliphatic polyhydric alcohol, aromatic polyhydric alcohol and derivatives thereof. As long as an amorphous resin can be obtained, a saturated aliphatic polyhydric alcohol may be used in combination.

Examples of the unsaturated aliphatic polyhydric alcohol include unsaturated aliphatic diols such as 2-butene-1,4-diol, 3-butene-1,4-diol, 2-butyne-1,4-diol, 3-butyne-1,4-diol, and 9-octadecene-7,12-diol. The derivatives of these compounds may also be used.

Examples of the unsaturated aromatic polyhydric alcohol include bisphenols such as bisphenol A, bisphenol F, alkylene oxide adducts of bisphenols such as ethylene oxide adducts and propylene oxide adducts thereof, 1,3,5-benzenetriol, 1,2,4-benzenetriol, and 1,3,5-trihydroxymethylbenzene. The derivatives of these compounds may also be used. Among these, bisphenol A compounds such as ethylene oxide adducts of bisphenol A and propylene oxide adducts are preferably used, from the viewpoint that the thermal properties may be easily optimized.

The number of carbon atoms of the trihydric or higher polyhydric alcohol is not particularly limited, but it is preferably within the range of 3 to 20 carbon atoms, since it is easy to optimize thermal properties.

These polyhydric alcohols may be used alone or in combination of two or more.

(Hybrid Resin)

The crystalline resin according to the present invention is preferably a hybrid resin in which a crystalline polyester segment (also referred to as a polyester polymerization segment) and a resin unit other than a crystalline polyester (also referred to as other polymerization segment) are chemically bonded. The hybrid resin according to the present invention may be of one kind or more. Further, the hybrid resin may be replaced with the whole amount of the crystalline polyester, or may be partly replaced (or used in combination).

In the present embodiment, the hybrid resin is a resin in which a crystalline polyester segment and an amorphous resin segment are chemically bonded. The crystalline polyester segment means a portion derived from the crystalline polyester. That is, it means a molecular chain having the same chemical structure as that of the above-mentioned crystalline polyester. Further, the amorphous resin segment means a portion derived from the amorphous resin. In other words, it means a molecular chain having the same chemical structure as that of the above-mentioned amorphous resin.

The Mw (weight average molecular weight) of the hybrid resin is preferably in the range of 5,000 to 100,000, more preferably in the range of 7,000 to 50,000, and particularly preferably in the range of 8,000 to 20,000, from the viewpoint that sufficient low-temperature fixability and excellent long-term storage stability can be ensured at the same time. By setting the Mw of the hybrid resin to 100.000 or less, sufficient low-temperature fixability may be obtained. On the other hand, by setting the Mw of the hybrid resin to 5,000 or more, excessive progress of compatibility between the hybrid resin and the amorphous resin at the time of storing of the toner is suppressed. Thereby, it is possible to effectively suppress image defects caused by toner fusion.

The crystalline polyester segment may be, for example, a resin having a structure in which a main chain of a crystalline polyester segment is copolymerized with other components, or a resin having a structure in which a crystalline polyester segment is copolymerized with a main chain composed of another component. The crystalline polyester segment can be synthesized from the aforementioned polyvalent carboxylic acid and polyhydric alcohol in the same manner as the above-mentioned crystalline polyester.

A content of the crystalline polyester segment in the hybrid resin is preferably in the range of 80 mass % to less than 95 mass %, more preferably in the range of 85 mass % to less than 95 mass % from the viewpoint of giving a sufficient crystalline property to the hybrid resin.

The constituents and the content of each segment in the hybrid resin (or in the toner) may be determined, for example, by using known analysis methods such as NMR and methylation reaction Pyrolysis Gas Chromatography with Mass Spectrometry (Py-GC/MS).

It is preferable that the crystalline polyester segment further contains a monomer having an unsaturated bond in the monomer from the viewpoint of introducing a chemical bonding site with the amorphous resin segment into the segment. The monomer having an unsaturated bond is, for example, a polyhydric alcohol having a double bond. Examples thereof include: a polyvalent carboxylic acid having a double bond such as methylene succinic acid, fumaric acid, maleic acid, 3-hexenedioic acid, 3-octenedioic acid: 2-butene-1,4-diol, 3-hexene-1,6-diol and 4-octene-1,8-diol. The content of the constituent unit derived from the unsaturated bond-containing monomer in the crystalline polyester segment is preferably in the range of 0.5 to 20 mass %.

The hybrid resin may be a block copolymer or a graft copolymer. However, a graft copolymer is preferred from the viewpoint of easily controlling the orientation of the crystalline polyester segment and imparting sufficient crystallinity to the hybrid resin. It is preferable that the crystalline polyester segment is grafted in a comb shape with a polymerization segment other than polyester as a main chain and a polyester resin segment as a side chain. That is, the hybrid resin is preferably a graft copolymer having the amorphous resin segment as the main chain and the crystalline polyester segment as the side chain.

A functional group such as a sulfonic acid group, a carboxy group, and a urethane group may be further introduced into the hybrid resin. Introduction of the functional group may be in the crystalline polyester segment or in the amorphous resin segment.

The amorphous resin segment enhances the affinity between the amorphous resin constituting the binder resin and the hybrid resin. Thereby, the hybrid resin is easily taken into the amorphous resin, and charging uniformity of the toner is further improved. The constituent components and the content of the amorphous resin segment in the hybrid resin (or in the toner) may be specified by using known analysis methods such as NMR and methylation reaction Pyrolysis Gas Chromatography with Mass Spectrometry (Py-GC/MS).

Further, similarly to the above-mentioned amorphous resin, the amorphous resin segment preferably has a glass transition temperature (Tg) in the range of 30 to 80° C. more preferably in the range of 40 to 65° C. in the first heating process of DSC. The glass transition temperature (Tg) may be measured by the method described above.

It is preferable that the amorphous resin segment is composed of the same kind of resin as the amorphous resin (vinyl-based resin in this embodiment) contained in the binder resin from the viewpoint of enhancing the affinity with the binder resin, and enhancing charging uniformity of the toner. By adopting such a form, the affinity between the hybrid resin and the amorphous resin is further improved. Here, "the same kind of resin" indicates the resin in which a characteristic chemical bond is commonly included in the repeating unit.

The meaning of "the characteristic chemical bond" is determined by "polymer classification" indicated in a database provided by National Institute for Material Science (NIMS): (http://polymer.nims.go.jp(PoLyInfo/guide/jp/term_polymer.html). Namely, the chemical bonds which constitute the following 22 kinds of polymers are called as "the characteristic chemical bonds": polyacryls, polyamides, polyacid anhydrides, polycarbonates, polydienes, polyesters, poly-halo-olefins, polyimides, polyimines, polyketones, polyolefins, polyethers, polyphenylenes, polyphosphazenes, polysiloxanes, polystyrenes, polysulfides, polysulfones, polyurethanes, polyureas, polyvinyls and other polymers.

"The same kind of resins" for the copolymer resins indicates resins having a common characteristic chemical bond in the chemical structure of a plurality of monomers which constitute the copolymer, when the copolymer has the monomers including the above-described chemical bonds as constituting units. Consequently, even if the resins each have a different property with each other, and even if the resins each have a different molar ratio of the monomers which constitute the copolymers, the resins are considered to be the same kind of resins as long as they contain a common characteristic chemical bond.

For example, the resin (or the resin unit) formed with styrene, butyl acrylate and acrylic acid and the resin (or the resin unit) formed with styrene, butyl acrylate and methacrylic acid both have at least a chemical bond constituting polyacrylate. Therefore, these two resins are the same kind of resins. Further examples are as follows. The resin (or the resin unit) formed with styrene, butyl acrylate and acrylic acid and the resin (or the resin unit) formed with styrene, butyl acrylate, acrylic acid, terephthalic acid, and fumaric acid both have at least a chemical bond constituting polyacrylate. Therefore, these two resins are also the same kind of resins.

Examples of the amorphous resin segment include a styrene-acrylic resin unit a vinyl resin unit, a urethane resin unit and a urea resin unit. Among them, from the viewpoint of easy control of the thermoplasticity, a vinyl resin unit is preferably used. The vinyl-based resin unit can be synthesized in the same manner as the vinyl-based resin described above.

The content of the constituent unit derived from the styrene monomer in the amorphous resin segment is preferably in the range of 40 to 90 mass % from the viewpoint of easily controlling the plasticity of the hybrid resin. From the same viewpoint, the content of the constitutional unit derived from the (meth)acrylic acid ester monomer in the amorphous resin segment is preferably in the range of 10 to 60 mass %.

Further, it is preferable that the amorphous resin segment further contains the amphoteric compound described above as a monomer from the viewpoint of introducing a chemical bonding site with the crystalline polyester segment into the amorphous resin segment. The content of the constitutional unit derived from the amphoteric compound in the amorphous resin segment is preferably in the range of 0.5 to 20 mass %.

From the viewpoint of imparting sufficient crystallinity to the hybrid resin, the content of the amorphous resin segment in the hybrid resin is preferably 5 mass % or more and less than 20 mass %, more preferably 5 mass % or more and less than 15 mass %.

The above hybrid resin can be produced, for example, by the following first to third production methods.

<<First Production Method>>

The first production method is a method for producing a hybrid resin by carrying out a polymerization reaction of synthesizing a crystalline polyester segment in the presence of a previously synthesized amorphous resin segment.

In this method, an amorphous resin segment is formed with an addition reaction of monomers constituting the above-described amorphous resin segment (preferably, vinyl monomers such as a styrene monomer and a (meth)acrylate monomer).

Subsequently, a polyhydric alcohol component and a polycarboxylic acid component are made to be polycondensed under the presence of the amorphous resin segment to form a crystalline polyester resin segment. During the moment in which a polyhydric alcohol component and a polycarboxylic acid component are made to be polycondensed, the polyhydric alcohol component or the polycarboxylic acid component is made to conduct an addition reaction to the amorphous resin segment. Thus, a hybrid resin is formed.

In the above-described first production method, it is preferable to incorporate into the crystalline polyester segment or the amorphous resin segment a site where these segments can react with each other. Specifically, at the time of synthesis of the amorphous resin segment, the amphoteric compound described above is also used in addition to the monomer constituting the amorphous resin segment. The amphoteric compound reacts with a carboxy group or a hydroxyl group in the crystalline polyester segment, whereby the crystalline polyester segment chemically and quantitatively bonds with the amorphous resin segment. Further, at the time of synthesizing the crystalline polyester segment, the monomer may further contain the above-mentioned compound having an unsaturated bond.

According to the first production method described above, a hybrid resin having a structure (graft structure) in which a crystalline polyester segment is molecularly bonded to an amorphous resin segment can be synthesized.

<<Second Production Method>>

The second production method is a method in which a crystalline polyester segment and an amorphous resin segment are respectively formed, and these are bonded to produce a hybrid resin.

In this method, a polyvalent carboxylic acid component and a polyhydric alcohol component are made to be polycondensed to form a crystalline polyester resin segment. Apart from a reaction system to form a crystalline polyester resin segment, an amorphous resin segment is formed by making an addition polymerization of monomers constituting the amorphous resin segment. At this time, it is preferable to incorporate, in one or both of the crystalline polyester segment and the amorphous resin segment, portions where the crystalline polyester segment and the amorphous resin segment can react with each other as described above.

Subsequently, by reacting the above-described crystalline polyester resin segment with the amorphous resin segment, a hybrid resin having a structure containing a molecular bond between the crystalline polyester resin segment and the amorphous resin segment can be formed.

When the above-described portions which may react are not incorporated in the crystalline polyester resin segment and the amorphous resin segment, a co-existing system of the crystalline polyester resin segment and the amorphous resin segment may be formed at first, then a method of adding a compound having a portion which can be bonded to the crystalline polyester resin segment and the amorphous resin segment may be adopted. A hybrid resin having a structure containing a molecular bond between the crystalline polyester resin segment and the amorphous resin segment may be formed.

<<Third Production Method>>

The third production method is a method for producing a hybrid resin by carrying out a polymerization reaction for synthesizing an amorphous resin segment in the presence of a crystalline polyester segment.

In this method, first, a polycondensation reaction of a polyvalent carboxylic acid and a polyhydric alcohol is performed to synthesize a crystalline polyester segment. Next, in the presence of the crystalline polyester segment, a monomer constituting the amorphous resin segment is polymerized to synthesize an amorphous resin segment. At this moment, it is preferable to incorporate sites capable of reacting with each other in the crystalline polyester segment or the amorphous resin segment, similarly to the first production method.

By using the above-described method, a hybrid resin having a structure of a molecular bond (a graft structure) of the crystalline polyester resin segment bonded with the amorphous resin segment can be formed.

Among the above-mentioned first to third manufacturing methods, the first production method is preferably used since this method enables to easily form a hybrid resin having a structure of an amorphous resin chain bonded with a crystalline polyester resin chain as a grafted portion, and this method can simplify the production method. The first production method contains the steps of forming an amorphous resin segment at first, then making to bond a crystalline polyester resin segment. Consequently, the orientation of the crystalline polyester resin segment will be uniform. Therefore, it is preferable from the viewpoint of reliably synthesizing a hybrid resin suitable for the toner of the present invention.

<Releasing Agent>

As the releasing agent according to the present invention, known releasing agents can be used. The releasing agent may be of one kind or more.

Examples of the waxes include polyolefin waxes, such as polyethylene wax and polypropylene wax; branched hydrocarbon waxes, such as microcrystalline wax; long-chain hydrocarbon waxes, such as paraffin wax and SASOL wax; dialkyl ketone waxes, such as disteatyl ketone; ester waxes, such as carnauba wax, montan wax, behenyl behenate, trimethylolpropane tribehenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediaminebehenylamide and trimellitic tristearylamide.

The above-described releasing agent is easily compatibilized with the vinyl resin. Therefore, due to the plasticizing effect of the releasing agent, the sharp melting property of the toner may be enhanced and sufficient low-temperature fixing property may be obtained. From the viewpoint of obtaining sufficient low-temperature fixability, the releasing agent is preferably an ester type wax (ester type compound). From the viewpoint of simultaneously achieving both heat resistance and low-temperature fixing property, it is more preferable to use a linear ester wax (linear ester compound). In the present invention, it is preferable to include two kinds of release agents as a release agent, and it is preferable that behenyl behenate and microcrystalline wax are used in combination.

The melting point Tmr of the releasing agent is preferably 60° C. or more, more preferably 65° C. or more, from the viewpoint of obtaining sufficient high-temperature storage property. The melting point Tmr of the releasing agent is preferably 90° C. or less, more preferably 75° C. or less, from the viewpoint of obtaining sufficient low-temperature fixability of the toner. Further, the content of the releasing agent in the toner of the present invention is preferably in the range of 1 to 30 mass %, and more preferably in the range of 5 to 20 mass %.

The toner of the present invention may further contain other components than the above-mentioned crystalline resin, amorphous resin and releasing agent, within the range that produces the effect of the present embodiment. For example, examples of the other components that may be contained in the toner mother particles include a colorant and a charge controlling agent.

<Colorant>

The colorant according to the present invention may be one kind or more. Examples of typical colorants include colorants for each of magenta, yellow, cyan and black colors.

Examples of the colorant for magenta include C. I. Pigment Red 2, 3, 5, 6, 7, 15, 16, 48:1, 53:1.57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238 and 269.

Examples of the colorant for yellow include C. I. Pigment Orange 31 and 43; and C. I Pigment Yellow 12, 14, 15, 17, 74, 83, 93, 94, 138, 155, 162, 180 and 185.

Examples of the colorant for magenta include C. I. Pigment Blue 2, 3, 15, 15:2, 15:3, 15:4, 16, 17, 60, 62, and 66; and C. I. Pigment Green 7.

Examples of the colorant for black include carbon black and magnetic substance particles. Examples of the carbon black include channel black, furnace black, acetylene black, thermal black, and lamp black. Examples of the magnetic substance particles include ferromagnetic metals such as iron, nickel, and cobalt; alloys containing these metals; compounds of ferromagnetic metals such as ferrite and magnetite; chromium dioxide; and alloys not containing a ferromagnetic metal but exhibiting ferromagnetism by heat treatment. Examples of the alloys exhibiting ferromagnetism by heat treatment include Heusler alloys such as manganese-copper-aluminum and manganese-copper-tin.

The content of the colorant in the toner base particles may be determined appropriately and independently. From the viewpoint of ensuring color reproducibility of the image, it is preferable that the content be in the range of 1 to 30 mass %, and more preferably in the range of 2 to 20 mass %.

The particle size of the colorant in terms of volume average particle diameter is preferably in the range of 10 to 1,000 nm, more preferably in the range of 50 to 500 nm, still more preferably in the range of 80 to 300 nm. The volume average particle diameter may be a catalog value, and for example, the volume average particle diameter (volume-based median diameter) of the colorant may be measured by "UPA-150" (manufactured by MicrotracBEL, Co., Ltd.).

<Charge Controlling Agent>

A variety of known charge controlling agent particles may be used. Examples thereof include: nigrosine dyes, metal salts of naphthenic acid or higher fatty acids, alkoxylated amines, quaternary ammonium salts, azo metal complexes, and salicylic acid metal salts. The content of the charge controlling agent in the toner of the present invention is usually in the range of 0.1 to 10 mass pans with respect to 100 mass parts of the binder resin, preferably in the range of 0.5 to 5 mass %.

The particle size of the charge controlling agent is, for example, in the range of 10 to 1,000 nm, preferably in the range of 50 to 500 nm, and more preferably in the range of 80 to 300 nm in terms of number average primary particle diameter.

<External Additive>

The external additive according to the present invention may be one kind or more. The external additive adheres to the surface of the above-described toner mother particles to improve charging performance, fluidity, and cleaning proper as a toner. Examples of the external additive include inorganic fine particles, organic fine particles and a lubricant.

Examples of the inorganic compound in the inorganic fine particles include silica, titania, alumina, and strontium titanate. If necessary, the inorganic fine particles may be subjected to a hydrophobilizing treatment with a known surface treatment agent such as a silane coupling agent or silicone oil. The size of the inorganic fine particles is preferably in the range of 20 to 500 nm, more preferably in the range of 70 to 300 nm, in terms of the number average primary particle diameter.

As the organic fine particles, organic fine particles composed of a homopolymer of styrene or methyl methacrylate or a copolymer thereof may be used. The organic fine particles have a number average primary particle diameter of about 10 to 2,000 nm, and their particle shape is, for example, spherical.

The lubricant is used to further improve the cleaning characteristics and transfer characteristics of the toner. Specific examples of the lubricant are metal salts of stearic acid with zinc, aluminum, copper, magnesium, and calcium; salts of oleic acid with zinc, manganese, iron, copper, and magnesium; salts of palmitic acid with zinc, copper, magnesium, and calcium; salts of linoleic acid with zinc and calcium; and salts of ricinoleic acid with zinc and calcium. The size of the lubricant is preferably in the range of 0.3 to 20 μm, more preferably in the range of 0.5 to 10 μm, in terms of volume-based median diameter (volume average particle diameter).

The volume-based median diameter of the lubricant can be determined according to JIS Z 8825-1 (2013).

The particle size of the external additive may be a catalog value or an actually measured value. The volume average particle diameter of the external additive is determined as follows. One hundred primary particles of the external additive on the toner mother particles are observed with a scanning electron microscope (SEM) apparatus, and the maximum diameter and the shortest diameter of each external additive are measured by image analysis of the observed primary particles. From the intermediate value, the sphere equivalent diameter is obtained, and it is obtained as the diameter ($D_{50}$) of 50% in the cumulative frequency of the obtained sphere equivalent diameter. The volume average particle diameter of the external additive may be adjusted, for example, by grinding of the coarse product, classifying or mixing of the classified product.

The amount of the external additive added to the toner mother particles is preferably in the range of 0.1 to 10.0 mass parts with respect to 100 mass parts of the toner mother particles. The above external additives may be added to toner mother particles using various known mixing devices such as turbulent mixer. Henschel mixer. Nauta mixer, and V type mixer.

<Morphology of Toner Mother Particle>

The toner mother particles may have a so-called single layer structure or may have a core-shell structure (a form in which a resin forming a shell layer is coagulated and fused on the surface of core particles). It is preferable to have a core-shell structure from the viewpoint of further improving the low-temperature fixability. The core-shell structure is not limited to a structure in which the shell layer completely covers the core particle, and, for example, a structure in which the shell layer does not completely cover the core particle and the core particle is partially exposed is also included. From the viewpoint of improving the chargeability under high temperature and high humidity environment, it is preferable that the toner of the present invention has a structure in which the crystalline polyester resin is not exposed on the surface of the toner mother particles but is contained in the toner mother particles and the amorphous resin is exposed on the surface of the toner mother particles.

The form of the toner mother particles (the cross-sectional structure of the core-shell structure and the position of the crystalline polyester resin) described above can be confirmed by known means such as a transmission electron microscope (TEM) or a scanning probe microscope (SPM).

<Average Circularity of Toner Mother Particles>

From the viewpoint of improving low-temperature fixability, the toner mother particles of the present invention preferably have an average circularity in the range of 0.920 to 1.000, more preferably in the range of 0.940 to 0.995.

The average circularity of the toner particles is measured with a flow-type particle image analyzer "FPIA-2100" (manufactured by Sysmex Corporation).

Specifically, a measuring sample (toner mother particles) is wetted in an aqueous surfactant solution, and is ultrasonically dispersed for one minute. After making the dispersion, the average circularity is measured with the analyzer "FPIA-2100" in a high power field (HPF) mode at an appropriate density (the number of particles to be detected at an HPF: 4000 particles). The circularity is calculated from the following expression:

Circularity=(Perimeter of a circle having the same projected area as the particle image)/(Perimeter of the projected image of the particle)

The average circularity indicates the arithmetic average value obtained by dividing the sum of circularities of particles by the number of particles.

<Particle Diameter of Toner Mother Particles>

With respect to the particle diameter of the toner mother particles, the volume-based median diameter ($D_{50}$) is preferably 3 to 10 μm. By setting the volume-based median diameter within the above-mentioned range, reproducibility of thin lines and high image quality of photographic images may be achieved, and toner consumption may be reduced as compared with the case of using large toner particles. In addition, toner fluidity may be ensured. Here, the volume-based median diameter ($D_{50}$) of the toner mother particles can be measured and calculated using, for example, an apparatus of "Coulter Multisizer 3" (manufactured by Beckman Coulter, Inc.) connected with a computer system for data processing. The volume-based median diameter of the toner mother particles may be controlled by the concentration of the coagulant in the aggregation/fusion step at the time of production of the toner, the amount of the solvent added, or the fusion time, and further the composition of the resin component.

[Production Method of Toner]

The production method of the toner according to the present invention is not particularly limited, and any known methods may be used. Examples of the known method include: a kneading pulverization method, suspension polymerization method, emulsion aggregation method, dissolution suspension method, polyester elongation method, dispersion polymerization method. Among these processes, preferred is an emulsion aggregation method in view of the uniformity of the particle size and control of the shape of the toner, and ease of forming the core-shell structure.

<Emulsion Aggregation Method>

The emulsion aggregation method is a method in which a dispersion liquid of particles of a resin produced by emulsification (hereinafter also referred to as "resin particles") is mixed with a dispersion liquid of colorant particles (hereinafter also referred to as "colorant particles"), then aggregation is carried out until the desired particle size is reached, and the shape control is carried out by further fusing the resin particles to produce toner base particles. Here, the resin particles may contain a releasing agent and, if necessary, a charge control agent.

As described above, in the emulsion aggregation method, a dispersion liquid of resin particles dispersed by a surfactant or a dispersion stabilizer is mixed with a dispersion liquid of constituent components of toner mother particles such as colorant particles as necessary. The aggregating agent is added to aggregate until a desired particle size is reached, and thereafter, or at the same time with coagulation, fusion of the resin fine particles is carried out, and the shape control is carried out to form toner mother particles. Instead of the aqueous dispersion of releasing agent-containing vinyl resin fine particles, an aqueous dispersion of releasing agent particles and an aqueous dispersion of vinyl resin fine particles may be separately prepared and mixed.

When toner mother particles are produced by an emulsion aggregation method, a manufacturing method including the following steps is adopted, for example. Here, in the following example, two kinds of crystalline polyester resins and an amorphous resin (vinyl resin) are used as a binder resin. Specifically, the case where the vinyl resin particle contains a release agent, the crystalline resin particle is a crystalline polyester resin particle, and the toner mother particle contains a coloring agent has been described. But it is not limited to this as long as the obtained toner satisfies the relationship of the above-mentioned formulas (1) and (2).

(A) Dispersion Liquid Preparation Step (A-1) Preparation step of dispersion liquid containing vinyl resin fine particles containing a releasing agent (A-2) Preparation step of dispersion liquid containing crystalline polyester resin fine particles by dissolving the crystalline polyester resin in an organic solvent, emulsifying and dispersing it in an aqueous dispersion medium, and removing the organic solvent (A-3) Preparation step of colorant particle dispersion liquid according to need (B) Mixing step of the releasing agent-containing vinyl resin fine particle dispersion liquid, the crystalline polyester resin fine particle dispersion liquid, and optionally the colorant particle dispersion liquid to aggregate and fuse (hereinafter also referred to as aggregation-fusion step)

Hereinafter, the steps (A) to (B) and the steps (C) to (G) which are arbitrarily performed besides these steps (A) to (B) will be described in detail.

(A) Dispersion Liquid Preparation Step (A-1) Preparation Step of Dispersion Liquid Containing Vinyl Resin Fine Particles Containing a Releasing Agent This step is a step of synthesizing a vinyl resin constituting the toner mother particles, dispersing the vinyl resin in the form of particles in an aqueous medium, and further adding a releasing agent to prepare a dispersion liquid of the vinyl resin fine particles.

As a method of dispersing the vinyl resin in the aqueous medium, there are two methods: a method (I) of forming vinyl resin fine particles from a monomer for obtaining a vinyl resin and preparing an aqueous dispersion of the vinyl resin fine particles: and a method (II) of preparing an oil phase liquid by dissolving or dispersing the vinyl resin in an organic solvent (solvent), and dispersing the oil phase liquid in an aqueous medium by phase inversion emulsification to prepare oil droplets having a desired particle size and then removing the organic solvent (solvent). In these methods (I) and (II), it is preferable to add a releasing agent together with the vinyl resin monomer (or vinyl resin).

In the method (I), first, a monomer for obtaining a vinyl resin is added to an aqueous medium together with a polymerization initiator and polymerized to obtain basic particles. Next, a radical polymerizable monomer for obtaining a vinyl resin and a polymerization initiator are added to the dispersion liquid in which the basic particles are dispersed, and a radical polymerizable monomer is seed polymerized in the basic particles. This method is preferably used. When adding the radical polymerizable monomer and the polymerization initiator, it is preferable to add a releasing agent at the same time. At this time, as the polymerization initiator, a water-soluble polymerization initiator may be used. As the water-soluble polymerization initiator, for example, water-soluble radical polymerization initiators such as potassium persulfate and ammonium persulfate may be suitably used. For a seed polymerization reaction system for obtaining vinyl resin fine particles, a generally used chain transfer agent can be used for the purpose of adjusting the molecular weight of the vinyl resin. As the chain transfer agent, octyl mercaptan, dodecyl mercaptan, t-dodecyl mercaptan, n-octyl-3-mercaptopropionate, stearyl-3-mercaptopropionate, and styrene dimer may be used.

In the method (II), as the organic solvent (solvent) used for preparing the oil phase liquid, from the viewpoint of easy removal treatment after the formation of oil droplets, those having a low boiling point and low solubility in water are preferred as described above. Specific examples thereof are: methyl acetate, ethyl acetate, methyl ethyl ketone, isopropyl alcohol, methyl isobutyl ketone, toluene, and xylene. These may be used alone or in combination of two or more.

The amount of the organic solvent (solvent) to be used (the total amount used when two or more types are used) is usually 10 to 500 mass parts with respect to 100 mass parts of the vinyl resin. The amount of the aqueous medium to be used is preferably 50 to 2,000 mass parts based on 100 mass parts of the oil phase liquid. By setting the amount of the aqueous medium to be in the above range, it is possible to emulsify and disperse the oil phase liquid to a desired particle size in the aqueous medium.

Further, a dispersion stabilizer, a surfactant, and resin fine particles may be added to the aqueous medium. Emulsification dispersion of such an oil phase liquid can be carried out using mechanical energy. The dispersing machine for carrying out the emulsification dispersion is not particularly limited. Examples thereof include: a wet emulsifying-dispersing machine, a homogenizer, a low speed shearing type dispersing machine, a high speed shearing type dispersing machine, a friction type dispersing machine, a high pressure jet type dispersing machine, an acoustic wave dispersing machine, and a high pressure impact type dispersing machine Ultimizer. Removal of the organic solvent after formation of the oil droplets is carried out by gradually increasing the temperature of the dispersion liquid in a state where the vinyl resin fine particles are dispersed in the aqueous medium while stirring and applying strong stirring in a certain temperature range to perform desolvation. Alternatively, the organic solvent may be removed under reduced pressure by using an apparatus such as an evaporator.

In the method (II), an aqueous dispersion of a releasing agent (releasing agent particle dispersion) separately prepared is added to the dispersion liquid containing the obtained vinyl resin fine particles to prepare a dispersion liquid of the releasing agent-containing vinyl resin fine particles. The aqueous medium used in the aqueous dispersion of the releasing agent refers to one containing at least 50 mass % of water, and as a component other than water, an organic solvent soluble in water can be mentioned. Examples thereof include: methanol, ethanol, isopropanol, butanol, acetone, methyl ethyl ketone, dimethylformamide, methyl cellosolve, and tetrahydrofuran. Among them, alcohol-based organic solvents such as methanol, ethanol, isopropanol, and butanol, which are organic solvents that do not dissolve the resin, are preferably used. More preferably, only water is used as the aqueous medium. In addition, amine and ammonia may be dissolved in the aqueous medium in order to stably emulsify in an aqueous phase to smoothly carry out emulsification. Further, in order to improve the dispersion stability of the oil droplets, a surfactant, or resin fine particles may be added.

As the surfactant, known anionic surfactants, cationic surfactants, nonionic surfactants and amphoteric surfactants may be used. As the surfactant, it is preferable to use an anionic surfactant since it is excellent in dispersion stability of oil droplets by vinyl resin and stability against temperature change is obtained. As the anionic surfactant, known ones may be used, and one type of them may be used alone or two or more types may be used in combination as desired. Examples of the resin fine particles for improving dispersion stability include: polymethyl methacrylate resin fine particles, polystyrene resin fine particles, and polystyrene-acrylonitrile resin fine particles.

The content of the releasing agent particles in the release agent particle dispersion liquid is preferably in the range of 10 to 50 mass %, and more preferably in the range of 15 to 40 mass %. Within such a range, an effect of preventing hot offset and securing separability are obtained. The dispersion diameter of the vinyl resin fine particles (oil droplets) in the vinyl resin fine particle dispersion liquid prepared by the above method (I) or (II) is preferably from 60 to 1,000 nm in volume-based median diameter (volume average particle diameter). The dispersion diameter of this oil droplet can be controlled by the magnitude of the mechanical energy at the time of emulsification dispersion. The content of the vinyl resin fine particles in the vinyl resin fine particle dispersion liquid is preferably in the range of 5 to 50 mass %, more preferably in the range of 10 to 30 mass %. Within such a range, the spread of the particle size distribution can be suppressed, and the toner characteristics can be improved. Here, the vinyl resin fine particles may also be composite particles formed of a plurality of layers composed of two or more layers of resins having different compositions.

(Fine Particle Dispersion Liquid Containing Only Releasing Agent)

In the step (1) of preparing the release agent-containing vinyl resin fine particle dispersion liquid, the vinyl resin fine particles contain a releasing agent. However, a fine particle dispersion liquid containing only a release agent may be used without incorporating a releasing agent in vinyl resin fine particles.

(A-2) Preparation Step of Dispersion Liquid Containing Crystalline Polyester Resin Fine Particles by Dissolving the Crystalline Polyester Resin in an Organic Solvent, Emulsifying and Dispersing it in an Aqueous Dispersion Medium, and Removing the Organic Solvent This step is preferably configured to include the following steps.

(A-2-1) Synthesis step of crystalline polyester resin (A-2-2) Preparation step of crystalline polyester resin fine particle dispersion liquid (A-2-1) Synthesis Step of Crystalline Polyester Resin The method for producing the crystalline polyester resin is not particularly limited, and it may be produced by a general polyester polymerization method of reacting a polyvalent carboxylic acid with a polyhydric alcohol. For example, direct polycondensation or transesterification method may be selectively used depending on the type of monomer. Since the catalyst that can be used in the production of the crystalline polyester resin has been described above, a detailed explanation is omitted here.

The use ratio of the polyhydric alcohol and the polyvalent carboxylic acid is preferably such that the equivalent ratio [OH]/[COOH] of the hydroxy group [OH] of the polyhydric alcohol and the carboxy group [COOH] of the polyvalent carboxylic acid is from 1.5/1 to 1/1.5, and more preferably from 1.2/I to 1/1.2. Further, the polymerization temperature and the polymerization time are not particularly limited, and the interior of the reaction system may be reduced in pressure during polymerization.

(A-2-2) Preparation Step of Crystalline Polyester Resin Fine Particle Dispersion Liquid The preparation step of crystalline polyester resin fine particle dispersion liquid is a step of preparing a dispersion liquid of crystalline polyester resin fine particles by dispersing the above-synthesized crystalline polyester resin in fine particles in an aqueous medium.

As a method for preparing the crystalline polyester resin fine particle dispersion, there are two methods, for example: (i) a method in which a crystalline polyester resin is dispersed in an aqueous medium without using a solvent; and (ii) a method in which the crystalline polyester resin is dissolved in a solvent such as ethyl acetate, methyl ethyl ketone, and toluene to prepare a solution, emulsifying and dispersing the solution in an aqueous medium using a dispersing machine, and subjecting the desolvation treatment (desolvation step). The aqueous medium used in (i) and (ii) above is one containing at least 50 mass % of water, and as a component other than water, an organic solvent soluble in water may be mentioned. As the organic solvent, the same organic solvents as those described in the step (A-1) above may be mentioned.

Further, amine or ammonia may be dissolved in the aqueous medium, as described in the step (A-1) above or a surfactant, resin fine particles may be added. As the surfactant and resin fine particles, the same ones as those described in the step (A-1) above may be used.

In the above (ii), the synthesized crystalline polyester resin is dissolved in an organic solvent to prepare a crystalline polyester resin solution. Thereafter, the crystalline polyester resin solution is emulsified and dispersed in an aqueous medium to form oil droplets made of a crystalline polyester solution. In this step, when the material prepared by a phase inversion emulsification method is used, oil droplets may be uniformly dispersed by changing the stability of the carboxy group of the polyester. It is superior in that it does not forcibly disperse with a shearing force as in the mechanical emulsification method. The "phase inversion emulsification method" includes: a dissolution step of dissolving a resin in an organic solvent to obtain a resin solution; a neutralization step of charging a neutralizing agent into the resin solution; an emulsification step of emulsifying and dispersing the neutralized resin solution in an aqueous dispersion medium to obtain a resin emulsion; and a desolvation step of removing the organic solvent from the resin emulsion. Through these steps, a dispersion liquid of resin fine particles is obtained.

The dispersion treatment (emulsification dispersion) in the above (i) and (ii) may be carried out using mechanical energy. The dispersing machine is not particularly limited, and a dispersing machine similar to that described in the step (A-1) above may be used. The particle size of the crystalline polyester resin fine particles in the dispersion can be controlled by adjusting the amount of neutralizing agent added, that is, adjusting the degree of neutralization. As the amount of neutralizing agent added is small, that is, the degree of neutralization is low, the particle diameter of the resin particles in the dispersion tends to increase.

In the above method (ii), particles of the crystalline polyester resin are produced by distilling off the organic solvent from the formed oil droplets, and a dispersion liquid of the crystalline polyester resin fine particles is prepared. Specifically, the distillation of the organic solvent is preferably carried out at a temperature in the range of 30 to 50° C. in a state where the degree of vacuum is within the range of 400 to 50,000 Pa. The dispersion diameter of the crystalline polyester resin fine particles (oil droplets) in the crystalline polyester resin fine particle dispersion prepared in this manner is preferably from 30 to 500 nm in volume-based median diameter (volume converted diameter: obtained by converting measured particle volume to sphere equivalent diameter). The dispersion diameter of the oil droplets may also be controlled by the magnitude of the mechanical energy at the time of emulsification dispersion. The dispersion diameter of the crystalline polyester resin fine particles (oil droplets) may be measured by a dynamic light scattering method, for example, using "Microtrac UPA 150" (manufactured by Nikkiso Co., Ltd.).

The content of the crystalline polyester resin fine particles in the crystalline polyester resin fine particle dispersion liquid is preferably in the range of 10 to 50 mass %, more preferably in the range of 15 to 40 mass %, based on 100 mass % of the dispersion liquid. Within such a range, the spread of the particle size distribution may be suppressed, and the toner characteristics may be improved.

(A-3) Preparation Step of Colorant Particle Dispersion Liquid

The preparation step of colorant particle dispersion liquid is a step of preparing a dispersion liquid of colorant particles by dispersing the colorant in the form of particles in an aqueous medium. Since the colorant is dispersed uniformly, it is preferable that the dispersion treatment of the colorant is performed in a state in which the concentration of the surfactant in the aqueous medium is at least the critical micelle concentration (CMC). The aqueous medium is as described in the above (A-2-2), and in the aqueous medium, a surfactant or resin fine particles may be added for the purpose of improving dispersion stability. The dispersion of the colorant may be carried out by using mechanical energy. There is no particular limitation on such a disperser, and the one described in the step (A-1) above may be used.

The dispersion diameter of the colorant particles in the colorant particle dispersion is preferably in the range of 10 to 300 nm in volume-based median diameter. The dispersion diameter of the colorant particles in the colorant particle dispersion liquid may be measured by a dynamic light scattering method, for example, using "Microtrac UPA 150" (manufactured by Nikkiso Co., Ltd.).

As a dispersion method for preparing the colorant dispersion liquid, there is no specific limitation. For example, a general dispersion method such as a rotary shearing type homogenizer, a ball mill having a medium, a sand mill, or a Dyno mill may be used. If necessary, an aqueous dispersion of a colorant may be prepared using a surfactant, or an organic solvent dispersion of a colorant may be prepared using a dispersant. As the surfactant and dispersant used for dispersing, the same dispersing agent that can be used for dispersing the binder resin may be used. In preparing the raw material dispersion liquid, the colorant dispersion liquid may be mixed at once with a dispersion liquid in which other particles are dispersed, or may be added and mixed in multiple steps by dividing. The content of the colorant contained in the colorant dispersion liquid may be usually in the nmge of 5 to 50 mass % or in the range of 10 to 40 mass %. When the content is within the above range, the particle size distribution of the colorant particles does not widen and the characteristics are good.

(B) Aggregation-Fusion Step

The aggregation-fusion step is a step in which, the crystalline polyester resin particles, the releasing agent-containing vinyl resin fine particles, and the colorant, the releasing agent, the charge control agent, and other constituents of toner mother particles are aggregated in the aqueous medium, and at the same to fuse these components with each other.

In this step, first, a crystalline polyester resin particle dispersion liquid, a releasing agent-containing vinyl resin particle dispersion liquid, and optionally a colorant particle dispersion liquid are mixed, and these particles are dispersed in an aqueous medium. In the case of producing a clear toner, an aggregation-fusion step is carried out without adding a colorant particle dispersion liquid.

Next, after adding a coagulant, heating is performed at a temperature equal to or higher than the glass transition point of the resin particles to promote aggregation, and at the same time, the resin particles are fused together.

The coagulant used in this step is not limited in particular, but it is preferably selected from metal salts of alkali metal salts and alkali earth metal salts. Such metal salts include, for example, monovalent metal salts such as salts of sodium, potassium and lithium; divalent metal salts of calcium, magnesium, manganese and copper, and trivalent metal salts of iron and aluminum. Specific examples of such metal salts include sodium chloride, potassium chloride, lithium chloride, calcium chloride, magnesium chloride, zinc chloride, copper sulfate, magnesium sulfate, and manganese sulfate. Among them, divalent metal salts and trivalent metal salts are particularly preferred since the aggregation is caused by a smaller amount. These coagulants may be used alone or in combination of two or more kinds. The amount of the coagulant to be used is not particularly limited, but it is preferably in the range of 0.1 to 20 mass parts based on 100 mass parts of the solid content of the binder resin constituting the toner mother particles, more preferably it is in the range of 1 to 15 mass parts.

In the aggregation step, it is preferable to quickly raise the temperature by heating after adding the coagulant, and the heating rate is preferably 0.05° C./min or more. The upper limit of the heating rate is not particularly limited, but it is preferably 15° C./min or less from the viewpoint of suppressing generation of coarse particles due to rapid progress of fusion process. Further, after the aggregating dispersion reaches a desired temperature, it is essential to continue the fusion process by maintaining the temperature of the aggregating dispersion liquid for a certain period of time, preferably until the volume-based median diameter reaches 4.5 to 7.0 μm.

In the case of obtaining toner mother particles having a core-shell structure, an aqueous dispersion of a resin forming a shell is further added in this step. The resin forming the shell is aggregated and fused to the surface of the resin particle (core particle) of the single layer structure obtained as described above. Thereby, toner mother particles having a core-shell structure may be obtained (shell formation step). At this time, following the shell formation step, heat treatment of the reaction system, that is. (C) aging step to be described later, may be carried out until the shell aggregation and fusion to the surface of the core panicle are further strengthened and the shape of the particles becomes a desired shape. The heat treatment of this reaction system may be carried out until the average circularity of the toner mother particles having a core-shell structure is within the range of the above average circularity.

(C) Aging Step

This step is done according to necessity. In this aging step, an aging treatment is performed in which aggregated particles obtained by the aggregation-fusion step are aged by thermal energy until they have a desired shape to form toner mother particles.

Specifically, the ripening treatment is carried out by heating and stirring the system in which associated particles are dispersed and adjusting the heating temperature, agitation speed, and heating time until the shape of associated particles reaches the desired circularity.

(D) Cooling Step

This step is a process to cool the dispersion liquid of toner mother particles. As a condition of coding treatment, it is preferable to cool the dispersion liquid at a coding rate of 1 to 20° C./min. A specific cooling method is not limited in particular. It may be cited: a coding method of introducing a coolant from outside of the reaction vessel; and a cooling method of directly introducing water into a reaction system.

(E) Filtering-Washing Step

This step is a process to remove the adhered materials such as a surface-active agent and a coagulant from the toner cake (an assembled body having a shape of a cake made of wet toner mother particles) and to wash, the toner cake being obtained by the solid-liquid separation from the cooled dispersion liquid of the toner mother particles. A solid-liquid separation method is not limited in particular. It may be used: a centrifugation method, a reduced filtration method using an apparatus such as a Buchner funnel, a filtration method using an apparatus such as a filter press.

(F) Drying Step

This step is a process to dry the washed toner cake. It may be done with a drying step in the preparation method of generally known toner mother particles.

Specific examples of a dryer used for the toner cake are: a spray drier, a vacuum freeze dryer, and a vacuum dryer. It is preferable to use an apparatus such as a static shelf dryer, a mobile shelf dryer, a fluidized bed dryer, a rotary dryer, and a stirring dryer.

(G) External Additive Adding Step

This step is a process to add an external additive to the toner mother particles according to need. As an external additive mixing device, a mechanical mixing device such as a Henschel mixer, a coffee mill, and a sample mill may be used.

<Developer>

The electrostatic image developing toner of the present invention may be used as a magnetic or non-magnetic single-component toner, or it may be used as a two-component developer by mixing with a carrier. When the toner of the present invention is used as a two-component developer, as a carrier constituting the two-component developer, there may be utilized magnetic particles composed of materials conventionally known in the art including metals such as iron, ferrite, and magnetite, or alloys of these metals with aluminum or lead. Specifically, ferrite particles are preferable.

As a carrier, a coated carrier prepared by coating the magnetic particles with a resin, or a resin dispersion type carrier prepared by dispersing magnetic particles in a resin may be used.

The volume-based median diameter ($D_{50}$) of the carrier is preferably 20 to 100 μm, it is more preferably 25 to 80 μm. It is possible to determine the volume-based median diameter ($D_{50}$) of the carrier by using laser diffraction system particle size distribution meter "HELOS" (manufactured by Sympatec GmbH) provided with a wet type dispersing apparatus. The two-component developer may be prepared by mixing the carrier and the toner by using a mixing device. Examples of the mixing apparatus include Hcnschel mixer, Nauta mixer, and V type mixer. The amount of the toner when preparing the two-component developer is preferably in the range of 1 to 10 mass % with respect to 100 mass % of the total of the carrier and the toner.

[Image Forming Method]

The image forming method according to the present invention includes forming an image forming layer on the recording medium using the toner of the present invention. The image forming method according to the present invention is a method using the toner of the present invention and may be suitably used for a full-color image forming method. In the full-color image forming method, the following methods may be used: a method using a 4 cycle type image forming apparatus constituted by four types of color developing devices related to each of yellow, magenta, cyan, and black and one electrostatic latent image bearing member (also referred to as "electrophotographic photoreceptor" or simply "photoreceptor"); and a method using a tandem type image forming apparatus in which image forming units each having a color developing device and an electrostatic latent image bearing member for each color are mounted for each color. Any image forming method may be used. In addition, in the case of further using the clear toner, the following methods may be used: a method of using a 5 cycle type image forming apparatus constituted by 5 types of color developing devices related to each of yellow, magenta, cyan, black, and clear and one electrostatic latent image bearing member (also referred to as "electrophotographic photoreceptor" or simply "photoreceptor"); and a method of using a tandem type image forming apparatus in which a developing device for each color including clear toner and an image forming unit having an electrostatic latent image bearing member are mounted for each color.

As an image forming method, an image forming method including a fixing step by a heat pressure fixing method capable of applying pressure while heating may be preferably cited.

In this image forming method, specifically, an electrostatic latent image formed on the photoreceptor is developed by using the above-described toner to obtain a toner image. This toner image is transferred to an image support, and thereafter the toner image transferred onto the image support is fixed to the image support by a fixing process of a heat pressure fixing system. Thereby it is possible to obtain a printed matter on which a visible image is formed. The pressure application and heating in the fixing step are preferably simultaneous. Alternatively, pressure may be applied first, followed by heating.

Further, the image forming method according to the present invention is suitably used in an image forming method of a heat pressure fixing system. As a fixing device of the heat pressure fixing system used in the image forming method according to the present invention, various known ones can be adopted. Hereinafter, a heat roller type fixing device and a belt heating type fixing device will be described as a thermal pressure fixing device.

(i) Fixing Device of Heat Roller System

A heat roller type fixing device generally has a pair of rollers composed of a heating roller and a pressure roller in contact with the heating roller. In the fixing device, the pressure roller is deformed by the pressure applied between the heating roller and the pressure roller, so that a so-called fixing nip portion is formed in this deformed portion. In general, the heating roller is formed by disposing a heat source such as a halogen lamp inside a core metal made of a hollow metal roller made of aluminum. In the heating roller, the core metal is heated by the heat source. At this time, the energization to the heat source is controlled and the temperature is adjusted so that the outer peripheral surface of the heating roller is maintained at a predetermined fixing temperature. In the case where the fixing device is used in an image forming apparatus for forming a full color image consisting of four toner layers (yellow, magenta, cyan and black) or five layers of toner (yellow, magenta, cyan, black and clear) which is required to have a capability of sufficiently heating and melting a toner image to cause color mixing, the fixing device is preferable to have the following configuration. That is, the fixing device preferably includes a core metal having a high heat capacity as a heating roller and including a core layer formed with an elastic layer for unifonmly melting a toner image on the outer peripheral surface of the core metal preferable.

Further, the pressure roller has an elastic layer made of a soft rubber such as urethane rubber or silicone rubber. As the pressure roller, it is also possible to use a core metal having a hollow metal roller made of aluminum and having an elastic layer formed on the outer peripheral surface of the core metal. Further, when the pressure roller has a core metal, a heat source such as a halogen lamp may be disposed in the core metal in the same manner as the heating roller. It may be configured to control the temperature by controlling the energization to the heat source so that the core metal is heated by the heat source and the outer peripheral surface of the pressure roller is maintained at a predetermined fixing temperature. As these heating rollers and pressurizing rollers, it is preferable to use one which has an outermost layer provided with a releasing layer made of a fluoro resin such as polytetrafluoroethylene (PTFE), or tetrafluoroethylene-perfluoroalkylvinylether copolymer (PFA). In such a heat roller type fixing apparatus, the pair of rollers is rotated and the image support that forms a visible image is conveyed to a fixing nip portion. Thereby, heating by the heating roller and application of pressure in the fixing nip portion are performed, whereby the unfixed toner image is fixed on the image support.

In the image forming method according to the present invention, the low-temperature fixability is also good. Therefore, in the fixing device of the heat roller type, the temperature of the heating roller may be made comparatively low, specifically 150° C. or less. Further, the temperature of the heating roller is preferably 140° C. or less, more preferably 135° C. or less. From the viewpoint of excellent low-temperature fixability, the temperature of the heating roller is preferably as low as possible, and its lower limit value is not particularly limited, but is substantially around 90° C.

(ii) Fixing Device of Belt Heating System

A belt heating type fixing device generally comprises a heating member made of, for example, a ceramic heater, a pressure roller, and a fixing belt made of a heat resistant belt sandwiched between the heating member and the pressure roller. The pressure roller is deformed by the pressure applied between the heating member and the pressure roller. By this, a so-called fixing nip portion is formed in this deformed portion.

As the fixing belt, heat resistant belts and sheets made of polyimide are used. The fixing belt may have a configuration of: a heat-resistant belt or sheet made of polyimide as a substrate; and a releasing layer formed thereon made of a fluoro resin such as polytetrafluoroethylene (PTFE) or tetrafluoroethylene-perfluoroalkyl vinyl ether copolymer (PFA). Further, it may have a configuration in which an elastic layer made of rubber is provided between the substrate and the releasing layer.

In such a belt heating type fixing device, an image supporting member that carries an unfixed toner image is held and conveyed together with the fixing belt between a fixing belt and a pressure roller that forms a fixing nip portion. Thereby, heating by the heating member via the fixing belt and application of pressure at the fixing nip portion are performed, and the unfixed toner image is fixed on the image support. According to such a belt heating type fixing device, the heating member may be energized only at the time of image formation so as to generate heat at a predetermined fixing temperature. Therefore, it is possible to shorten the waiting time from when the image forming apparatus is powered on until the image formation can be executed. In addition, the power consumption of the image forming apparatus at the time of standby is extremely small, and power saving may be achieved.

As described above, the heating member, the pressure roller and the fixing belt used as the fixing member in the fixing step are preferably those having a plurality of layer configurations. In the belt heating type fixing apparatus, the temperature of the heating member may be made relatively low, specifically 150° C. or less. Further, the temperature of the heating member is preferably 140° C. or less, more preferably 135° C. or less. From the viewpoint of excellent low-temperature fixability, the temperature of the heating member is preferably as low as possible, and its lower limit value is not particularly limited, but is substantially 90° C. or so.

<Recording Medium>

Recording media (also referred to as recording materials, recording papers, or recording papers) may be those commonly used. For example, there is no particular limitation as long as it holds a toner image formed by a known image forming method using an image forming apparatus. Examples of usable image support materials include: plain paper from thin paper to thick paper, high-quality paper, art paper, or coated printing paper such as coated paper, commercially available Japanese paper or postcard paper, OHP Plastic films, cloths, various resin materials used for so-called soft packaging, resin films formed by molding them into a film, and labels.

Although the embodiment of the present invention has been described above, the present invention is not limited to the above embodiment, and various modifications can be made. The scope of the present invention should be interpreted by terms of the appended claims.

EXAMPLES

Hereinafter, the present invention will be specifically described with reference to examples, but the present invention is not limited thereto.

[Preparation of Colorant Particle Dispersion Liquid]

While stirring a solution of 90 mass parts of sodium dodecyl sulfate added to 1.600 mass parts of ion-exchanged water, 420 mass parts of copper phthalocyanine (CI Pigment Blue 15:3) was gradually added. And the mixture was dispersed using a stirring apparatus "CLEAR MIX" (manufactured by M Technique, Co., Ltd.) to prepare an aqueous dispersion of colorant particles having a solid content of 20 mass %.

With respect to the obtained aqueous dispersion of colorant particles, the average particle diameter (volume-based median diameter) of the colorant particles was measured using Microtrac UPA 150" (manufactured by Nikkiso, Co. Ltd.) and it was found to be 110 nm.

[Preparation of Vinyl Resin Particle Dispersion Liquid 1c]

(First Stage Polymerization)

Into a 5 L reaction vessel equipped with a stirrer, a temperature sensor, a cooling tube, and a nitrogen introducing device, 8 mass parts of sodium dodecyl sulfate and 3,000 mass parts of ion-exchanged water were charged. While stirring at a stirring speed of 230 rpm under a nitrogen flow, the inner temperature of the reaction vessel was raised to 80° C. After raising the temperature, a solution of 10 mass parts of potassium persulfate (KPS) dissolved in 200 mass parts of ion-exchanged water was added thereto, and the liquid temperature was raised again to 80° C. A mixed solution of the following monomer mixture was added dropwise to this solution over 1 hour.

Styrene (St): 480.0 mass parts n-Butyl acrylate (BA): 250.0 mass parts

Methacrylic acid (MAA): 68.0 mass parts

After dropping the mixture, the reaction system was heated and stirred at 80° C. for 2 hours to carry out the polymerization. Thus, a vinyl resin particle dispersion liquid was prepared.

(Second Stage Polymerization)

Into a 5 L reaction vessel equipped with a stirrer, a temperature sensor, a cooling tube, and a nitrogen introducing device, a solution of 6.0 mass parts of sodium polyoxyethylene (2) dodecyl ether sulfate dissolved in 3,000 mass parts of ion-exchanged water was charged. The solution was heated to 98° C. After heating, 80 mass parts in terms of solid content of the vinyl resin particle dispersion liquid prepared by the first stage polymerization, a mixed solution obtained by dissolving the following monomers, a chain transfer agent and a releasing agent at 90° C.

Styrene (St): 245.0 mass parts

2-Ethylhexyl acrylate (2EHA): 96.6 mass parts

Methacrylic acid (MAA): 37.0 mass parts n-Octyl-3-mercaptopropionate (NOM: chain transfer agent): 3.86 mass parts Behenyl behenate (releasing agent m, p. 73° C.): 172.8 mass parts The reaction system was mixed and dispersed for 1 hour by using a mechanical disperser with a circulation route "CLEARMIX" (manufactured by M Technique Co., Ltd.) so that a dispersion liquid containing emulsion particles (oil particles) was prepared. Then, an initiator solution of 5.2 mass parts of potassium persulfate dissolved in 200 mass parts of ion-exchanged water was added to the dispersion liquid, and the system was heated and stirred at 84° C. for 1 hour to carry out polymerization. Thereby a vinyl resin particle dispersion liquid was prepared.

(Third Stage Polymerization)

400 parts by mass of ion-exchanged water was further added To the amorphous vinyl resin particle dispersion liquid obtained by the second stage polymerization were further added 400 mass parts of ion-exchanged water and mixed thoroughly. Then, a solution of 7.04 mass parts of potassium persulfate dissolved in 400 mass parts of ion-exchanged water was added. Further, under the temperature condition of 82° C., a mixed solution of the following monomers and a chain transfer agent was added dropwise over 1 hour.

Styrene (St): 348.0 mass parts n-Butyl acrylate (BA): 169.1 mass parts

Methacrylic acid (MAA): 49.6 mass parts n-Octyl-3-mercapto propionate: 8.1 mass parts.

After completion of the addition, the solution was heated with stirring for 2 hours to carry out polymerization. After cooling to 28° C., a dispersion liquid of vinyl resin particles 1C (vinyl resin particle dispersion liquid 1c) was prepared.

[Preparation of Vinyl Resin Particle Dispersion Liquids 2c to 6c]

As in the case of the vinyl resin particle dispersion liquid 1c, except that the ratio of each material was changed based on the following Table I, dispersion liquids of vinyl resin particles 2C to 6C (vinyl resin particle dispersion liquids 2c to 6c) were prepared. For the vinyl resin particle dispersion liquids 2c to Sc, as shown in Table I, two releasing agents were used.

TABLE I

Unit: (mass parts)

| | First stage polymerization | | | | Second stage polymerization | | | | | | | Releasing agent | | Third stage polymerization | | | | |
|---|---|---|---|---|---|---|---|---|---|---|---|---|---|---|---|---|---|---|
| *1 | St | BA | MAA | KPS | *2 | St | BA | 2EHA | MAA | NOM | KPS | *3 | *4 | St | BA | MAA | NOM | KPS |
| 1c | 480.0 | 250.0 | 68.0 | 10 | 289.0 | 245.0 | — | 96.6 | 37.0 | 3.86 | 5.2 | 172.8 | — | 348.0 | 169.1 | 49.6 | 8.1 | 7.04 |
| 2c | 480.0 | 250.0 | 68.0 | 10 | 289.0 | 245.0 | — | 96.6 | 37.0 | 3.86 | 5.2 | 164.2 | 8.6 | 348.0 | 169.1 | 49.6 | 8.1 | 7.04 |
| 3c | 480.0 | 250.0 | 68.0 | 10 | 289.0 | 245.0 | — | 96.6 | 37.0 | 3.86 | 5.2 | 155.52 | 17.28 | 348.0 | 169.1 | 49.6 | 8.1 | 7.04 |
| 4c | 480.0 | 250.0 | 68.0 | 10 | 289.0 | 234.5 | 53.55 | 53.55 | 37.0 | 3.86 | 5.2 | 164.2 | 8.6 | 348.0 | 169.1 | 49.6 | 8.1 | 7.04 |
| 5c | 480.0 | 250.0 | 68.0 | 10 | 289.0 | 221.5 | 120.13 | — | 37.0 | 3.86 | 5.2 | 164.2 | 8.6 | 348.0 | 169.1 | 49.6 | 8.1 | 7.04 |
| 6c | 480.0 | 250.0 | 68.0 | 10 | 289.0 | 221.5 | 120.13 | — | 37.0 | 3.86 | 5.2 | 172.8 | — | 348.0 | 169.1 | 49.6 | 8.1 | 7.04 |

*1: Vinyl resin particle dispersion liquid No.

*2: First stage polymerization liquid

*3: Behenyl behenate

*4: Microcrytalline wax

[Preparation of Dispersion Liquid of Releasing Agent Particles]

Behenyl behenate (releasing agent, melting point 73° C.): 100 mass parts

Anionic surfactant (Neogen RK, manufactured by Daiichi Kogyo Seiyaku, Co., Ltd.): 10 mass parts Ion-exchanged water: 400 mass parts The above materials were mixed and heated to 80° C. and thoroughly dispersed with ULTRA TURRAX T50 (manufactured by IKA Co. Ltd.). Thereafter, dispersion treatment was carried out with a pressure discharge type Gaulin homogenizer, and ion exchange water was added to the dispersion to adjust the solid content to 15% to prepare a releasing agent particle dispersion liquid (WI). The volume-based median diameter of the releasing agent particles in this dispersion was measured with a laser diffraction type particle size distribution analyzer LA-750 (manufactured by HORIBA. Co. Ltd.), and it was found to be 220 nm.

[Production of Amorphous Polyester Resin]

A mixed solution of a vinyl resin monomer, a monomer having a substituent reactive with any of the amorphous polyester resin and the vinyl resin, and a polymerization initiator described below was placed in a dropping funnel.

Styrene: 80.0 mass parts
N-Butyl acrylate: 20.0 mass parts
Acrylic acid: 10.0 mass parts
Di-t-butyl peroxide (polymerization initiator): 16.0 mass parts In addition, the following amorphous polyester resin monomers were placed in a four-necked flask equipped with a nitrogen introduction tube, a dehydration tube, a stirrer and a thermocouple, and heated to 170° C. for dissolution.

Bisphenol A ethylene oxide 2 mol adduct: 59.1 mass parts
Bisphenol A propylene oxide 2 mol adduct: 281.7 mass parts
Terephthalic acid: 63.9 mass parts
Succinic acid: 48.4 mass parts Under stirring, the mixed solution in the dropping funnel was dropped into a four-necked flask over 90 minutes, aged for 60 minutes, and unreacted monomers were removed under reduced pressure (8 kPa). Thereafter, 0.4 mass parts of Ti $(OBu)_4$ as an esterification catalyst was added, and the temperature was raised to 235° C. The reaction was carried out under atmospheric pressure (101.3 kPa) for 5 hours and under reduced pressure (8 kPa) for 1 hour. Subsequently, the reaction mixture was cooled to 200° C., it was reacted under reduced pressure (20 kPa), and then it was desolvated to obtain an amorphous polyester resin. The amorphous polyester resin thus obtained had a weight average molecular weight (Mw) of 24,000, an acid value of 16.2 mg KOH/g, and a glass transition temperature (Tg) of 60° C.

[Preparation of Dispersion Liquid of Amorphous Polyester Resin Particles]

Next, 100 mass parts of the obtained amorphous polyester resin was dissolved in 400 mass parts of ethyl acetate (manufactured by Kanto Chemical Co., Inc.), and the resin solution was mixed with 638 mass parts of a 0.26 mass % of sodium lauryl sulfate solution prepared in advance. Ultrasonic dispersion treatment was carried out for 30 minutes with V-LEVEL400 μA with an ultrasonic homogenizer US-150T (manufactured by Nihonseiki Kaisha Ltd.) while stirring the mixture. Thereafter, with heating to 40° C. ethyl acetate was completely removed while stirring under reduced pressure for 3 hours using a diaphragm vacuum pump V-700 (manufactured by BUCHI, Co. Ltd.). Thereby, an amorphous polyester resin particle dispersion liquid having a solid content of 13.5 mass % was prepared. Amorphous polyester resin particles in the dispersion had a volume-based median diameter of 98 nin.

[Synthesis of Crystalline Polyester Resin 1A]

Raw material monomers for an addition polymerization resin (styrene-acrylic resin: StAc) unit including a bireactive monomer and a radical polymerization initiator as described below were loaded in a dropping funnel.

Styrene: 21.7 mass parts
n-Butyl acrylate: 8 mass parts
Acrylic acid: 1.8 mass parts
Di-t-butylperoxide (polymerization initiator): 4 mass parts Further, raw material monomers for a poly-condensation resin (crystalline polyester resin: CPEs) unit described below were introduced in a four-necked flask equipped with a nitrogen introducing device, a dehydration tube, a stirrer, and a thermocouple. Then, the mixture was heated to 170° C. to dissolve the content.

| | |
|---|---|
| Tetradecanedioic acid | 440 mass parts |
| Butanediol | 135 mass parts |

Subsequently, the raw material monomers for an addition polymerization resin (styrene-acrylic resin: StAc) was dropped over a period of 90 minutes, and an aging reaction was done for 60 minutes. Then, the unreacted raw material monomers for an addition polymerization resin were removed under a reduced pressure of 8 kPa. The amount of the removed monomers was very small compared with the raw monomers for the above-described resin.

Then, 0.8 mass parts of $Ti(OBu)_4$ was added as an esterification catalyst, and the mixture was heated to 235° C. The reaction was made under a normal pressure (101.3 kPa) for 5 hours, then further the reaction was made under a reduced pressure (8 kPa) for 1 hour.

Subsequently, the reaction mixture was cooled to 200° C., and the reaction was made under a reduced pressure (20 kPa) for 1 hour. Thus, a crystalline polyester resin 1A was obtained. The crystalline polyester resin 1A contained 5 mass % of a resin (StAc) unit other than the crystalline polyester resin (also referred to as "CPEs") based on the total amount of the crystalline polyester resin 1A, and is a resin in which CPEs was grafted to StAc. The crystalline polyester resin 1A thus obtained had a number average molecular weight (Mn) of 4,030, a weight average molecular weight (Mw) of 20.100, a melting point (Tmc) of 77° C. and a melt viscosity of 11.5 mPa·s.

[Synthesis of Crystalline Polyester Resin 2A]

A crystalline polyester resin 2A was obtained in the same manner as in the synthesis of the crystalline polyester resin 1A except that after cooling to 200° C., the reaction was changed to a reaction for 2 hours under reduced pressure (20 kPa). The crystalline polyester resin 2A contained 5 mass % of a resin (StAc) unit other than CPEs with respect to the total amount thereof, and it was a resin in which CPEs was grafted to StAc. The crystalline polyester resin 2A thus obtained had a number average molecular weight (Mn) of 4,060, a weight average molecular weight (Mw) of 24,800, a melting point (Tmc) of 78° C. and a melt viscosity of 13 mPa·s.

[Synthesis of Crystalline Polyester Resin 3A]

A crystalline polyester resin 3A was obtained in the same manner as in the synthesis of the crystalline polyester resin 1A except that after cooling to 200° C., the reaction was changed to a reaction for 0.5 hours under reduced pressure (20 kPa). The crystalline polyester resin 3A contained 5 mass % of a resin (StAc) unit other than CPEs with respect to the total amount thereof, and it was a resin in which CPEs was grafted to StAc. The crystalline polyester resin 3A thus obtained had a number average molecular weight (Mn) of 3,340, a weight average molecular weight (Mw) of 17,300, a melting point (Tmc) of 76° C. and a melt viscosity of 9.5 mPa·s.

[Synthesis of Crystalline Polyester Resin 4A]

A crystalline polyester resin 4A was obtained in the same manner as in the synthesis of the crystalline polyester resin 1A except that the raw material monomers of the addition polymerization type resin (styrene-acrylic resin: StAc) unit was changed as follows.

Styrene: 130.2 mass parts
n-Butyl acrylate: 48 mass parts
Acrylic acid: 10.8 mass parts
Di-t-butylperoxide (polymerization initiator): 24 mass parts The crystalline polyester resin 4A contained 30 mass % of a resin (StAc) unit other than CPEs with respect to the total amount thereof, and it was a resin in which CPEs was grafted to StAc. The crystalline polyester resin 4A thus obtained had a number average molecular weight (Mn) of 4,380, a weight average molecular weight (Mw) of 33,000, a melting point (Tmc) of 72° C. and a melt viscosity of 15 mPa·s.

[Synthesis of Crystalline Polyester Resin 5A]

A crystalline polyester resin 5A was obtained in the same manner as in the synthesis of the crystalline polyester resin 1A except that the raw material monomers of the addition polymerization type resin (styrene-acrylic resin: StAc) unit was changed as follows.

Styrene: 65.1 mass parts
n-Butyl acrylate: 24 mass parts
Acrylic acid: 5.4 mass parts
Di-t-butylperoxide (polymerization initiator): 12 mass parts The crystalline polyester resin 5A contained 15 mass % of a resin (StAc) unit other than CPEs with respect to the total amount thereof, and it was a resin in which CPEs was grafted to StAc. The crystalline polyester resin 5A thus obtained had a number average molecular weight (Mn) of 4,180, a weight average molecular weight (Mw) of 27,600, a melting point (Tmc) of 74° C. and a melt viscosity of 14 mPa·s.

[Synthesis of Crystalline Polyester Resin 6A]

A crystalline polyester resin 6A was obtained in the same manner as in the synthesis of the crystalline polyester resin 1A except that a raw material monomer of addition polymerization type resin (styrene-acrylic resin: StAc) unit was not used. The crystalline polyester resin 6A thus obtained had a number average molecular weight (Mn) of 3,140, a weight average molecular weight (Mw) of 13.300, a melting point (Tmc) of 80° C. and a melt viscosity of 8 mPa·s.

[Synthesis of Crystalline Polyester Resin 1B]

Raw material monomers for a poly-condensation resin (crystalline polyester resin: CPEs) unit were introduced in a four-necked flask equipped with a nitrogen introducing device, a dehydration tube, a stirrer, and a thermocouple. Then, the mixture was heated to 170° C. to dissolve the content.

| | |
|---|---|
| Tetradecanedioic acid | 440 mass parts |
| Hexanediol | 135 mass parts |

Then, 0.8 mass parts of $T(OBu)_4$ was added as an esterification catalyst, and the mixture was heated to 235° C. The reaction was made under a normal pressure (101.3 kPa) for 5 hours, then further the reaction was made under a reduced pressure (8 kPa) for 1 hour.

Subsequently, the reaction mixture was cooled to 200° C., and the reaction was made under a reduced pressure (20 kPa) for 1 hour. Thus, a crystalline polyester resin 1B was obtained. The crystalline polyester resin 1B thus obtained had a number average molecular weight (Mn) of 3,010, a weight average molecular weight (Mw) of 15,500, a melting point (Tmc) of 77° C. and a melt viscosity of 9.04 mPa·s.

[Synthesis of Crystalline Polyester Resin 2B]

Raw material monomers for a poly-condensation resin (crystalline polyester resin: CPEs) unit were introduced in a four-necked flask equipped with a nitrogen introducing device, a dehydration tube, a stirrer, and a thermocouple. Then, the mixture was heated to 170° C. to dissolve the content.

| | |
|---|---|
| Tetradecanedioic acid | 440 mass parts |
| Hexanediol | 135 mass parts |

Then, 0.8 mass parts of $T(OBu)_4$ was added as an esterification catalyst, and the mixture was heated to 235° C. The reaction was made under a normal pressure (101.3 kPa) for 5 hours, then further the reaction was made under a reduced pressure (8 kPa) for 1 hour.

Subsequently, the reaction mixture was cooled to 200° C., and the reaction was made under a reduced pressure (20 kPa) for 2 hour. Thus, a crystalline polyester resin 2B was obtained. The crystalline polyester resin 2B thus obtained had a number average molecular weight (Mn) of 4,310, a weight average molecular weight (Mw) of 20,000, a melting point (Tmc) of 77° C. and a melt viscosity of 12.6 mPa·s.

[Synthesis of Crystalline Polyester Resin 3B]

Raw material monomers for an addition polymerization resin (styrene-acrylic resin: StAc) unit including a bireactive monomer and a radical polymerization initiator as described below were loaded in a dropping funnel.

Styrene: 21.7 mass parts
n-Butyl acrylate: 8 mass parts
Acrylic acid: 1.8 mass parts
Di-t-butylperoxide (polymerization initiator): 4 mass parts Further, raw material monomers for a poly-condensation resin (crystalline polyester resin: CPEs) unit described below were introduced in a four-necked flask equipped with a nitrogen introducing device, a dehydration tube, a stirrer, and a thermocouple. Then, the mixture was heated to 170° C. to dissolve the content.

| | |
|---|---|
| Tetradecanedioic acid | 440 mass parts |
| Hexanediol | 135 mass parts |

Subsequently, the raw material monomers for an addition polymerization resin (styrene-acrylic resin: StAc) was dropped over a period of 90 minutes, and an aging reaction was done for 60 minutes. Then, the unreacted raw material monomers for an addition polymerization resin were removed under a reduced pressure of 8 kPa. The amount of the removed monomers was very small compared with the raw monomers for the above-described resin.

Then, 0.8 mass parts of $T(OBu)_4$ was added as an esterification catalyst, and the mixture was heated to 235° C. The reaction was made under a normal pressure (101.3 kPa) for 5 hours, then further the reaction was made under a reduced pressure (8 kPa) for 1 hour.

Subsequently, the reaction mixture was cooled to 200° C., and the reaction was made under a reduced pressure (20 kPa) for 1 hour. Thus, a crystalline polyester resin 3B was obtained. The crystalline polyester resin 3B contained 5 mass % of a resin (StAc) unit other than the crystalline polyester resin ("CPEs") based on the total amount of the crystalline polyester resin 3B, and is a resin in which CPEs was grafted to StAc. The crystalline polyester resin 3B thus obtained had a number average molecular weight (Mn) of 3,420, a weight average molecular weight (Mw) of 19,800, a melting point (Tmc) of 74° C. and a melt viscosity of 10.1 mPa·s.

[Preparation of Crystalline Polyester Resin Particle Dispersion Liquid 1a]

82 mass parts of the above-described crystalline polyester resin 1A were added in 82 mass parts of methyl ethyl ketone and the mixture was stirred at 70° C. for 30 minutes to dissolve. Then, while stirring this solution, 2.5 mass parts of 25 mass % of aqueous sodium hydroxide solution was added thereto. This solution was placed in a reaction vessel having a stirrer and 236 mass parts of water warmed to 70° C. were dropped and mixed over 70 minutes while stirring. During the dropwise addition, the liquid in the vessel became cloudy, and after the whole amount was dropped, a uniform emulsified state was obtained. The particle diameter of the oil droplets of this emulsion was measured with a laser diffraction type particle size distribution analyzer "LA-750 (manufactured by HORIBA, Co. Ltd.)", and as a result, the volume average particle diameter was 123 nm.

Subsequently, while keeping this emulsion at 70° C., the reaction mixture was stirred for 3 hours under a reduced pressure of 15 kPa (150 mbar) by using a diaphragm vacuum pump "V-700" (manufactured by BUCHI, Co. Ltd.). During this step, methyl ethyl ketone was removed to prepare "an aqueous dispersion of crystalline polyester resin particles (crystalline polyester resin particle dispersion liquid 1a)" (solid content: 25 mass %) in which the fine particles of the crystalline polyester resin 1A were dispersed. As a result of measurement with the particle size distribution measuring instrument, the volume average particle diameter of the crystalline polyester resin fine particles in the crystalline polyester resin particle dispersion liquid 1a was 75 nm.

[Preparation of Crystalline Polyester Resin Particle Dispersion Liquids 2a to 6a and 1b to 3b]

Aqueous dispersions of crystalline polyester resin particles (crystalline polyester resin particle dispersion liquids 2a to 6a and 1b to 3b) were prepared in the same manner as preparation of the crystalline polyester resin particle dispersion liquid 1a except that crystalline polyester resins 2A to 6A and 1B to 3B were respectively used in place of the crystalline polyester resin 1A. The volume average particle size of each crystalline polyester resin fine particles was 200 nm.

TABLE II

| | | Hybrid crystalline polyester resin composition ratio | | | | | |
|---|---|---|---|---|---|---|---|
| *1 | *2 | Crystalline polyester resin unit (segment) (mass parts) | Styrene-acryl copolymer unit (segment) (mass parts) | Melting point (° C.) | Melt viscosity (mPa · s) | Mn | mW |
| 1a | 1A | 95 | 5 | 77 | 11.5 | 4030 | 20100 |
| 2a | 2A | 95 | 5 | 78 | 13 | 4060 | 24800 |
| 3a | 3A | 95 | 5 | 76 | Z9.5 | 3340 | 17300 |
| 4a | 4A | 70 | 30 | 72 | 15 | 4380 | 33000 |
| 5a | 5A | 85 | 15 | 74 | 14 | 4180 | 27600 |
| 6a | 6A | 100 | 0 | 80 | 8 | 3140 | 13300 |
| 1b | 1B | 100 | 0 | 77 | 9.04 | 3010 | 15500 |
| 2b | 2B | 100 | 0 | 77 | 12.6 | 4310 | 20000 |
| 3b | 3B | 95 | 5 | 74 | 10.1 | 3420 | 19800 |

*1: Crystalline polyester resin particle dispersion liquid No.
*2: Crystalline polyester resin No.

[Preparation of Toner 1]

Into a reaction vessel equipped with a stirrer, a temperature sensor and a cooling tube, 346 mass parts (in terms of solid content) of the vinyl rein particle dispersion liquid c and 2,000 mass parts of ion-exchanged water were charged. The pH was adjusted to 10) by adding 5 mol/L sodium hydroxide aqueous solution at room temperature (23° C.). Further, 7 mass parts (in terms of solid content) of the colorant particle dispersion liquid were added, and a solution prepared by dissolving 60 mass parts of magnesium chloride in 60 mass parts of ion-exchanged water was added at 30° C. over 10 minutes with stirring. After standing for 3 minutes, it was heated to 80° C. over 60 minutes. After reaching 80° C. 36 mass parts (in terms of solid content) of the crystalline polyester resin particle dispersion 1a and 4 mass parts (in terms of solid content) of the crystalline polyester resin particle dispersion 1b were mixed and added over 20 minutes. The stirring speed was adjusted so that the growth rate of the particle diameter became 0.01 μm/min, and the mixture was grown until the volume-based median diameter measured by Coulter Multisizer 3 (manufactured by Beckman Coulter, Inc.) became 6.0 μm. Subsequently, 74 parts by mass (in terms of solid content) of amorphous polyester resin particle dispersion liquid was added over 30 minutes. When the supernatant of the reaction solution became transparent, an aqueous solution prepared by dissolving 190 mass parts of sodium chloride in 760 mass parts of ion-exchanged water was added to stop the growth of the particle size. Next, the temperature was elevated and agitated at 80° C., and fusion of the particles was allowed to proceed until the average degree of circularity of the toner mother particles reached 0.970, and then cooled to lower the liquid temperature to 30° C. or lower. Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to yield toner mother particles.

To 100 mass parts of the obtained toner mother particles, 0.6 mass parts of hydrophobic silica particles (number average primary particle size=12 nm, hydrophobicity=68), 1.0 mass parts of hydrophobic titanium oxide particles (number average primary particle size=20 nm, hydrophobicity=63), and 1.0 mass part of sol-gel silica particles (number average primary particle size=110 nm9 were added. The mixture was mixed at 32° C. for 20 minutes by using a "Henschel mixer" (Nippon Coke & Engineering, Co., Ltd.) in the condition of a rotary blade circumferential speed of 35 mm/sec. After mixing, coarse particles were removed using a sieve having an opening of 45 μm to obtain Toner 1.

[Preparation of Toners 2 to 8, 10 to 12, and 14 to 16]

Toners 2 to 8, 10 to 12, and 14 to 16 were prepared in the same manner as preparation of the above-described toner 1 except that the type and amount of the vinyl resin particle dispersion liquid, the crystalline polyester resin particle dispersion liquid, and the amount of the amorphous polyester resin dispersion liquid were varied based on the description in the following Table III.

[Preparation of Toner 9]

Into a reaction vessel equipped with a stirrer, a temperature sensor and a cooling tube, 346 mass parts (in terms of solid content) of the vinyl resin particle dispersion liquid 1c and 2,000 mass parts of ion-exchanged water were charged. The pH was adjusted to 10 by adding 5 mol/L sodium hydroxide aqueous solution at room temperature (25° C.). Further, 7 mass parts (in terms of solid content) of the colorant particle dispersion liquid were added, and a solution prepared by dissolving 60 mass parts of magnesium chloride in 60 mass parts of ion-exchanged water was added at 30° C. over 10 minutes with stirring. After standing for 3 minutes, it was heated to 80° C. over 60 minutes. After reaching 80° C., 60 mass parts (in terms of solid content) of the crystalline polyester resin particle dispersion 1a and 12 mass parts (in terms of solid content) of the crystalline polyester resin particle dispersion 1b were mixed and added over 20 minutes. The stirring speed was adjusted so that the growth rate of the particle diameter became 0.01 μm/min, and the mixture was grown until the volume-based median diameter measured by Coulter Multisizer 3 (manufactured by Beckman Coulter, Inc.) became 6.0 μm. Then, an aqueous solution prepared by dissolving 190 mass parts of sodium chloride in 760 mass parts of ion-exchanged water was added to stop the growth of the particle size. Next, the temperature was elevated and agitated at 80° C. and fusion of the particles was allowed to proceed until the average degree of circularity of the toner mother particles reached 0.970, and then cooled to lower the liquid temperature to 30° C. or lower. Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to yield toner mother particles.

To 100 mass parts of the obtained toner mother particles, 0.6 mass parts of hydrophobic silica particles (number average primary particle size=12 nm, hydrophobicity=68), 1.0 mass parts of hydrophobic titanium oxide particles (number average primary particle size=20 nm, hydrophobicity=63), and 1.0 mass part of sol-gel silica particles (number average primary particle size=110 nm9 were added. The mixture was mixed at 32° C. for 20 minutes by using a "Henschel mixer" (Nippon Coke & Engineering Co., Ltd.) in the condition of a rotary blade circumferential speed of 35 mm/sec. After mixing, coarse particles were removed using a sieve having an opening of 45 μm to obtain Toner 9.

[Preparation of Toner 13]

Into a reaction vessel equipped with a stirrer, a temperature sensor and a cooling tube, 511 mass parts (in terms of solid content) of amorphous polyester resin particle dispersion liquid, 73 mass parts of releasing agent particle dispersion liquid, and 2,000 mass parts of ion-exchanged water were charged. The pH was adjusted to 10 by adding 5 mol/L sodium hydroxide aqueous solution at room temperature (25° C.). Further, 7 mass parts (in terms of solid content) of the colorant particle dispersion liquid were added, and a solution prepared by dissolving 60 mass parts of magnesium chloride in 60 mass parts of ion-exchanged water was added at 30° C. over 10 minutes with stirring. After standing for 3 minutes, it was heated to 80° C. over 60 minutes. After reaching 80° C., 36 mass parts (in terms of solid content) of the crystalline polyester resin particle dispersion 1a and 4 mass parts (in terms of solid content) of the crystalline polyester resin particle dispersion 1b were mixed and added over 20 minutes. The stirring speed was adjusted so that the growth rate of the particle diameter became 0.01 μm/min, and the mixture was grown until the volume-based median diameter measured by Coulter Multisizer 3 (manufactured by Beckman Coulter, Inc.) became 6.0 μm. Subsequently, 74 parts by mass (in terms of solid content) of amorphous polyester resin particle dispersion liquid was added over 30 minutes. When the supernatant of the reaction solution became transparent, an aqueous solution prepared by dissolving 190 mass parts of sodium chloride in 760 mass parts of ion-exchanged water was added to stop the growth of the particle size. Next, the temperature was elevated and agitated at 80° C., and fusion of the particles was allowed to proceed until the average degree of circularity of the toner mother particles reached 0.970, and then cooled to lower the liquid temperature to 30° C. or lower. Thereafter, the temperature was raised to 50° C. over 30 minutes with stirring, and a heat treatment step was carried out for 3 hours. Thereafter, it was cooled and the liquid temperature was lowered to 30° C. or lower. Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to yield toner mother particles.

To 100 mass parts of the obtained toner mother particles, 0.6 mass parts of hydrophobic silica particles (number average primary particle size=12 nm, hydrophobicity=68), 1.0 mass parts of hydrophobic titanium oxide particles (number average primary particle size=20 nm, hydrophobicity=63), and 1.0 mass part of sol-gel silica particles (number average primary particle size=110 nm9 were added. The mixture was mixed at 32° C. for 20 minutes by using a "Henschel mixer" (Nippon Coke & Engineering Co., Ltd.) in the condition of a rotary blade circumferential speed of 35 mm/sec. After mixing, coarse particles were removed using a sieve having an opening of 45 μm to obtain Toner 13.

[Preparation of Toner 17]

Toner 17 was prepared in the same manner as preparation of the above-described toner 9 except that the type and amount of the vinyl resin particle dispersion liquid, the crystalline polyester resin particle dispersion liquid, and the amount of the amorphous polyester resin dispersion liquid were varied based on the description in the following Table III.

TABLE III

| Toner | Vinyl-based resin | | Crystalline polyester resin | | | | *2 | | | Releasing agent | |
|---|---|---|---|---|---|---|---|---|---|---|---|
| No. | Resin type | *1 | Resin type | *1 | Resin type | *1 | Resin type | *1 | | *1 | Remarks |
| 1 | Vinyl resin particles 1C | 68.5 | 1A | 9 | 1B | 1 | *3 | 10 | | 11.5 | Present invention |
| 2 | Vinyl resin particles 2C | 68.5 | 1A | 9 | 1B | 1 | *3 | 10 | | 11.5 | Present invention |
| 3 | Vinyl resin particles 3C | 68.5 | 1A | 9 | 1B | 1 | *3 | 10 | | 11.5 | Present invention |
| 4 | Vinyl resin particles 4C | 68.5 | 1A | 9 | 1B | 1 | *3 | 10 | | 11.5 | Present invention |
| 5 | Vinyl resin particles 1C | 68.5 | 2A | 9 | 1B | 1 | *3 | 10 | | 11.5 | Present invention |
| 6 | Vinyl resin particles 1C | 68.5 | 3A | 9 | 1B | 1 | *3 | 10 | | 11.5 | Present invention |
| 7 | Vinyl resin particles 1C | 68.5 | 1A | 9 | 2B | 1 | *3 | 10 | | 11.5 | Present invention |
| 8 | Vinyl resin particles 1C | 68.5 | 1A | 9 | 3B | 1 | *3 | 10 | | 11.5 | Present invention |
| 9 | Vinyl resin particles 1C | 71.6 | 1A | 15 | 1B | 3 | — | — | | 10.4 | Present invention |
| 10 | Vinyl resin particles 5C | 68.5 | 1A | 9 | 1B | 1 | *3 | 10 | | 11.5 | Present invention |
| 11 | Vinyl resin particles 6C | 68.5 | 1A | 9 | 1B | 1 | *3 | 10 | | 11.5 | Present invention |
| 12 | Vinyl resin particles 1C | 68.5 | 1A | 10 | — | — | *3 | 10 | | 11.5 | Present invention |
| 13 | Amorphous polyester resin particles | 69 | 1A | 9 | 1B | 1 | *3 | 10 | | 11 | Present invention |
| 14 | Vinyl resin particles 6C | 68.5 | 4A | 9 | 1B | 1 | *3 | 10 | | 11.5 | Comparative example |
| 15 | Vinyl resin particles 6C | 68.5 | 5A | 9 | 1B | 1 | *3 | 10 | | 11.5 | Comparative example |
| 16 | Vinyl resin particles 6C | 68.5 | 6A | 9 | 1B | 1 | *3 | 10 | | 11.5 | Comparative example |
| 17 | Vinyl resin particles 6C | 65.9 | 6A | 23 | — | — | — | — | | 11.1 | Comparative example |

*1: Composition ratio (mass parts)
*2: Shell (Amorphous polyester resin)
*3: Amorphous polyester

[Evaluation]

<Measurement of Loss Tangent Tan δ>

With respect to the obtained toners, measurements were carried out at a rate of temperature rise of 3° C./min and at 6° C./min, respectively, according to the above-mentioned measuring method of loss tangent tan δ. From the measured values, it was judged by the symbol of ○ or x whether the above formulas (1) to (6) were satisfied or not.

<Heat-Resistant Storage Property>

0.5 g of toner was taken in a 10 mL glass bottle having an inner diameter of 21 mm, the lid was closed and shaken 600 times at room temperature using a shaker "Tap Denser KYT-2000" (manufactured by Seishin Enterprise Co., Ltd.). Then, in a state where the lid was opened, it was left for 2 hours under an environment of a temperature of 55° C. and a humidity of 35b % RH. Subsequently, the entire amount of the toner was placed on a sieve of 48 mesh (mesh opening 350 spm) with care so as not to disaggregate toner aggregates, and set in a "powder tester" (manufactured by Hosokawa Micron Corp.). The sample was fixed with a holding bar and knob nut, a vibration intensity was adjusted to 1 mm in feed width, and vibration was applied for 10 seconds. After that, the ratio (mass %) of the amount of toner passed through the sieve was measured, and the toner aggregation rate was calculated by the following formula (A). Based on the obtained sieve passing rate, the heat resistant storage stability of the toner was evaluated. A sieve passing rate of 80% or more was judged to be acceptable.

Sieve passing rate (%)=(mass of toner measured on the sieve (g)−mass of residual toner on the sieve (g))/mass (g) of toner measured on the sieve×100 Formula (A):

◎: Sieve passing rate is 90% or more (heat-resistant storage stability of toner is extremely good)

○: Sieve passing rate is 85% or more and less than 90% (heat-resistant storage stability of toner is good)

Δ: Sieve passing rate is 80% or more and less than 85% (heat-resistant storage property of toner is good)

x: Sieve passing rate is less than 80% (poor heat-resistant storability of toner, it is unusable)

<Low-Temperature Fixability>

A commercially available full-color multifunction machine "bizhub C754" (manufactured by Konica Minolta, Inc.) was modified so that the surface temperature of the upper fixing belt and the lower fixing roller could be changed. This modified machine was used as an image forming apparatus. A solid image having a toner adhesion amount of 11.3 g/m$^2$ was printed on A4 (basis weight 80 g/m$^2$) plain paper at a nip width of 11.2 mm, a fixing time of 34 msec, a fixing pressure of 133 kPa, and a fixing temperature of 100 to 200° C. This test was repeated while changing the fixing temperature at 5° C. intervals. The lowest fixing temperature at which image smear due to fixing offset was not visually observed was determined as the lowest fixing temperature.

◎: Lowest fixing temperature is less than 135° C. (toner has extremely good low-temperature fixability)

○: Lowest fixing temperature is 135° C. or more and less than 145° C. (toner has good low-temperature fixability)

Δ: Lowest fixing temperature is 145° C. or more and less than 155° C. (toner has good low-temperature fixability)

x: Lowest fixing temperature is 155° C. or more (toner has bad low-temperature fixability, and it is unusable)

<Gloss Controllability>

A commercially available full-color multifunction machine "bizhub C754" (manufactured by Konica Minolta. Inc.) was modified so that the surface temperature of the upper fixing belt and the lower fixing roller could be changed. This modified machine was used as an image forming apparatus. A solid image having a toner adhesion amount of 8 g/m$^2$ was printed on A4 (basis weight 128 g/m$^2$) gloss coat paper at a nip width of 11.2 mm, a fixing pressure of 133 kPa, and fixing was conducted under one of the following conditions.

Condition 1: a fixing time of 34 msec, a fixing temperature of lowest fixing temperature+40° C. (high gloss condition)

Condition 2: a fixing time of 17 msec, a fixing temperature of lowest fixing temperature+10° C. (low gloss condition).

The glossiness controllability was evaluated based on the gloss difference between Condition 1 and Condition 2 by measuring the incident angle of 75° gloss of the fixed image.

◎: Difference in gloss of 40 or more (gloss controllability of toner is extremely good)

○: Difference in gloss from 30 or more to less than 40 (good gloss controllability of toner)

Δ: Difference in gloss from 20 or more to less than 30 (good gloss controllability of toner)

x: Difference in gloss less than 20 (gloss controllability of toner is bad and it is unusable)

TABLE IV

| Toner | tan δ | | | Formula | Formula | Formula | Formula | Formula | Formula | |
|---|---|---|---|---|---|---|---|---|---|---|
| No. | $\tan \delta_{3^\circ\ C./min}$ | $\tan \delta_{6^\circ\ C./min}$ | *A | (1) | (2) | (3) | (4) | (5) | (6) | Remarks |
| 1 | 1.3000 | 1.3650 | 0.0650 | ○ | ○ | ○ | ○ | ○ | ○ | *1 |
| 2 | 1.6040 | 1.6770 | 0.0730 | ○ | ○ | ○ | ○ | ○ | ○ | *1 |
| 3 | 0.9900 | 1.0700 | 0.0800 | ○ | ○ | ○ | ○ | X | X | *1 |
| 4 | 1.8000 | 1.9700 | 0.1700 | ○ | ○ | ○ | X | X | X | *1 |
| 5 | 1.2000 | 1.2500 | 0.0500 | ○ | ○ | ○ | ○ | ○ | ○ | *1 |
| 6 | 1.6600 | 1.6610 | 0.0010 | ○ | ○ | ○ | X | ○ | ○ | *1 |
| 7 | 0.8400 | 0.8600 | 0.0200 | ○ | ○ | ○ | ○ | X | X | *1 |
| 8 | 1.6200 | 1.6800 | 0.0600 | ○ | ○ | ○ | ○ | ○ | ○ | *1 |
| 9 | 1.4100 | 1.4105 | 0.0005 | ○ | ○ | X | X | ○ | ○ | *1 |
| 10 | 1.4500 | 1.5000 | 0.0500 | ○ | ○ | ○ | ○ | ○ | ○ | *1 |
| 11 | 1.6000 | 1.6300 | 0.0300 | ○ | ○ | ○ | ○ | ○ | ○ | *1 |
| 12 | 1.8300 | 1.8308 | 0.0008 | ○ | ○ | X | X | X | X | *1 |
| 13 | 1.5800 | 1.6200 | 0.0400 | ○ | ○ | ○ | ○ | ○ | ○ | *1 |
| 14 | 1.1400 | 1.1000 | −0.0400 | X | X | X | X | ○ | ○ | *2 |
| 15 | 1.2200 | 1.2203 | 0.0003 | ○ | X | X | X | ○ | ○ | *2 |
| 16 | 1.6490 | 1.6460 | −0.0030 | X | X | X | X | ○ | ○ | *2 |
| 17 | 1.9200 | 1.9150 | −0.0050 | X | X | X | X | X | X | *2 |

*1: Present invention

*2: Comparative example

*A: $\tan \delta_{6^\circ\ C./min} - \tan \delta_{3^\circ\ C./min}$

Formula (1) $\tan \delta_{3^\circ\ C./min} < \tan \delta_{6^\circ\ C./min}$

Formula (2) $0.0005 \leq \tan \delta_{6^\circ\ C./min} - \tan \delta_{3^\circ\ C./min}$ Formula (3) $0.001 \leq \tan \delta_{6^\circ\ C./min} - \tan \delta_{3^\circ\ C./min}$ Formula (4) $0.01 \leq \tan \delta_{6^\circ\ C./min} - \tan \delta_{3^\circ\ C./min} \leq 0.15$ Formula (5) $1.1 < \tan \delta_{6^\circ\ C./min} < 1.7$ Formula (6) $1.1 < \tan \delta_{3^\circ\ C./min} < 1.7$

TABLE V

| | *1 | | | | Gloss controllability | | | | |
|---|---|---|---|---|---|---|---|---|---|
| | Sieve passing | | *2 | | Low gloss | High gloss | | | |
| Toner No. | rate (%) | *3 | Temperature (° C.) | *3 | fixing condition | fixing condition | Difference in gloss | *3 | Remarks |
| 1 | 93 | ◎ | 133 | ◎ | 32 | 73 | 41 | ◎ | *4 |
| 2 | 91 | ◎ | 130 | ◎ | 38 | 80 | 42 | ◎ | *4 |
| 3 | 95 | ◎ | 145 | Δ | 25 | 67 | 42 | ◎ | *4 |
| 4 | 84 | Δ | 132 | ◎ | 35 | 58 | 23 | Δ | *4 |
| 5 | 94 | ◎ | 134 | ◎ | 27 | 62 | 35 | ○ | *4 |
| 6 | 87 | ○ | 131 | ◎ | 37 | 60 | 23 | Δ | *4 |
| 7 | 97 | ◎ | 150 | Δ | 20 | 45 | 25 | Δ | *4 |
| 8 | 91 | ◎ | 131 | ◎ | 35 | 73 | 38 | ○ | *4 |
| 9 | 92 | ◎ | 136 | ○ | 28 | 49 | 21 | Δ | *4 |
| 10 | 93 | ◎ | 134 | ◎ | 27 | 61 | 34 | ○ | *4 |
| 11 | 90 | ◎ | 132 | ◎ | 30 | 54 | 24 | Δ | *4 |
| 12 | 82 | Δ | 128 | ◎ | 45 | 67 | 22 | Δ | *4 |
| 13 | 90 | ◎ | 127 | ◎ | 42 | 71 | 29 | Δ | *4 |
| 14 | 80 | Δ | 134 | ◎ | 62 | 70 | 8 | X | *5 |
| 15 | 82 | Δ | 138 | ○ | 61 | 80 | 19 | X | *5 |
| 16 | 78 | X | 132 | ◎ | 68 | 81 | 13 | X | *5 |
| 17 | 70 | X | 122 | ◎ | 80 | 82 | 2 | X | *6 |

*1: Heat-resistant storage property

*2: Low-temperature fixability

*3: Evaluation

*4: Present invention

*5: Comparative example

From the results indicated in Table V, it is understood that the toner of the present invention is superior in heat-resistant storage property, low-temperature fixing property and gloss controllability as compared with the toner of comparative example.

What is claimed is:

1. An electrostatic image developing toner comprising: toner mother particles containing a binder resin and a releasing agent; and an external additive, wherein the binder resin contains a crystalline resin, and a vinyl-based resin as a main component being 50 mass % or more with respect to the mass of the binder resin, and the binder resin further contains an amorphous polyester resin in an amount of 11.3 mass % or less with respect to the mass of the binder resin;

the electrostatic image developing toner satisfies the following formulas (I) and (2), $$\tan \delta_{3^\circ\ C./min} < \tan \delta_{6^\circ\ C./min} \quad \text{Formula (1):}$$

$$0.0005 \leq \tan \delta_{6^\circ\ C./min} - \tan \delta_{3^\circ\ C./min}, \quad \text{Formula (2):}$$

wherein: $\tan \delta_{6^\circ\ C./min}$ is a peak top value of a loss tangent when the loss tangent is measured from 25° C. to 100° C. at a frequency of 1 Hz and a heating rate of 6° C./min; and $\tan \delta_{3^\circ\ C./min}$ is a peak top value of a loss tangent when the loss tangent is measured from 25° C. to 100° C. at a frequency of 1 Hz and a heating rate of 3° C./min, and wherein the toner mother particles have a core-shell structure, and the shell contains the amorphous polyester resin.

2. The electrostatic image developing toner described in claim 1 satisfying the following formula (3), $$0.001 \leq \tan \delta_{6^\circ\ C./min} - \tan \delta_{3^\circ\ C./min}. \quad \text{Formula (3):}$$

3. The electrostatic image developing toner described in claim 1 satisfying the following formula (4), $$0.01 \leq \tan \delta_{6^\circ\ C./min} - \tan \delta_{3^\circ\ C./min} \leq 0.15 \quad \text{Formula (4):}$$

4. The electrostatic image developing toner described in claim 1 satisfying the following formulas (5) and (6), $$1.1 \leq \tan \delta_{6^\circ\ C./min} \leq 1.7 \quad \text{Formula (5):}$$

$$1.1 \leq \tan \delta_{3^\circ\ C./min} \leq 1.7 \quad \text{Formula (6):}$$

5. The electrostatic image developing toner described in claim 1, wherein the crystalline resin contains a crystalline polyester resin.

6. The electrostatic image developing toner described in claim 1, wherein the crystalline resin contains a hybrid resin in which a crystalline polyester segment and a resin unit other than a crystalline polyester are chemically bonded.

7. The electrostatic image developing toner described in claim 1, wherein two crystalline resins with different melting points are contained as the crystalline resin.

8. The electrostatic image developing toner described in claim 1, wherein two releasing agents with different melting points are contained as the releasing agent.

* * * * *